United States Patent [19]

Tusso et al.

[11] 3,988,018

[45] Oct. 26, 1976

[54] PAPER SORTER

[75] Inventors: Robert Joseph Tusso, Randolph; Daniel Richard Erny, Boonton; James Edward Landrith, Andover, all of N.J.

[73] Assignee: Van Dyke Research Corporation, Whippany, N.J.

[22] Filed: Feb. 25, 1975

[21] Appl. No.: 552,964

[52] U.S. Cl. ..... 271/173; 271/202; 271/208; 271/209; 271/224

[51] Int. Cl.[2] ..... B65H 29/60; B65H 31/24

[58] Field of Search ..... 271/173, 64, 207, 208, 271/209, 224, 213, 202, 161, 188, 258, 259; 270/58

[56] References Cited

UNITED STATES PATENTS

| | | | |
|---|---|---|---|
| 2,426,957 | 9/1947 | Trump | 271/209 |
| 2,661,209 | 12/1953 | McGalliard | 271/173 |
| 3,062,537 | 11/1962 | Hanstein et al. | 271/80 |
| 3,273,882 | 9/1966 | Pearson | 271/173 |
| 3,460,824 | 8/1969 | Bahr et al. | 271/173 |
| 3,586,311 | 6/1971 | Schulze | 271/173 |
| 3,638,937 | 2/1972 | Schulz et al. | 271/173 |
| 3,744,790 | 7/1973 | Hoffman | 271/173 |
| 3,848,867 | 11/1974 | Johnson | 271/173 |

*Primary Examiner*—Johnny D. Cherry
*Assistant Examiner*—Bruce H. Stoner, Jr.
*Attorney, Agent, or Firm*—Arthur L. Lessler

[57] ABSTRACT

A fully automatic paper sorter designed for use as an accessory to an office copier or copier/duplicator machine. The sorter bins have a concave configuration which takes advantage of paper curl developed in the copier to provide more efficient utilization of available bin space. A speed buffering arrangement permits the sorter to operate with copiers having various speeds of paper movement. A separate paper diverting gate is associated with each paper receiving bin, the gates being activated in succession by a rotating cam stack. A sophisticated paper monitoring and control system detects various types of paper jams, and responds either by shutting down the sorter immediately, or by routing subsequent paper sheets directly to a paper catch tray, depending upon the type of jam involved. When the capacity of the sorter is exceeded, excess sheets are routed to the paper catch tray.

50 Claims, 23 Drawing Figures

PAPER SORTER

This invention relates to a paper sorter, and more particularly to a sorter adapted for use as an accessory to a printing, copying or duplicating machine.

Many types of copying and duplicating machines are presently on the market, and there is particular interest in machines of the electrophotographic type which provide "instant printing on either plain or photoconductor-coated paper. It is often desired to utilize these machines to photocopy reports, pamphlets, or other multi-page documents. Where the volume of such multi-page documents to be copied is substantial, it is desirable to provide a paper sorter positioned adjacent the copier, to receive the copies produced and automatically sort them into sets, each set corresponding to a complete copy of the multi-page document being reproduced.

It is highly desirable that the paper sorter provided as an accessory to a photocopying machine have a top surface at about the same height as the working surface of the copier, so that an extended work area is thereby provided, and the resulting arrangement is esthetically acceptable. This height restriction limits the number of sorting bins which can be provided by a given sorter, and if desired, additional storage bins can be provided, as is known in the art, by coupling additional sorter units in tandem. Typically, presently available sorters for use with office copiers have a capacity on the order of 10 bins per unit. The use of additional tandem units is relatively expensive, consumes additional floor space, and leads to decreased reliability due to the additional length of the paper travel path thus required.

Accordingly, there is a need for a paper sorter which is capable of providing more efficient utilization of the available space for its copy storage bins, which is capable of operation with copiers having varying paper movement speeds, which is highly reliable, and which requires a minimum of operating controls.

According to one feature of the invention, there is provided a paper sorter for sorting paper having a tendency to curl in a given direction. The sorter includes a plurality of stationary, vertically stacked paper receiving bins, and transport means for moving the paper sheets along a path having a vertical portion adjacent the bins. Gate means is disposed between the transport means and the bins for deflecting successive ones of the paper sheets into corresponding adjacent bins. Each bin has an arcuate configuration conforming to the direction of curl of the sheets, so that the effective storage capacity of the bins for a given overall height of the bin stack is increased.

According to another feature of the invention, there is provided a paper sorter for sorting paper sheets delivered by another apparatus. The sorter includes a plurality of stationary vertically stacked paper receiving bins, and transport means for moving the paper sheets along a path having a vertical portion adjacent the bins. The speed of movement of the transport means is substantially greater than the speed of delivery of the sheets by the aforementioned other apparatus. The transport means has a first portion adjacent the other apparatus for receiving the sheets delivered by said other apparatus. The first portion of the transport means includes means for grasping the sheets with a force substantially less than the force with which the sheets are held by the other apparatus, so that the sheets slip with respect to the first portion of the transport means until they are released by the other apparatus, at which time the first portion of the transport means grasps the sheets and accelerates them to the speed of movement thereof as soon as the sheets are released by the other apparatus. As a result, the speed of operation of the transport means is substantially independent of the speed of delivery of the paper sheets by the other apparatus. Also included is gate means disposed between the vertical portion of the transport means and the paper receiving bins, for deflecting successive paper sheets into corresponding adjacent bins.

According to still another feature of the invention, there is provided a paper sorter for sorting paper sheets, the sorter including a plurality of stationary vertically stacked paper receiving bins. Transport means is provided for moving the paper sheets along a path having a vertical portion adjacent the bins, said vertical portion including at least two vertically movable strips. The vertical portion of the transport means also includes a vertically aligned array of horizontal idler rollers disposed in contiguous relationship with the vertically movable strips, the rollers being disposed between the strips and paper receiving bins. A vertical paper supporting structure is disposed adjacent the rollers, and the strips protrude beyond the paper supporting structure to engage the rollers. A stationary elongated resilient element is provided for urging each strip against the rollers. Gate means is disposed between the paper supporting structure and the paper receiving bins for deflecting successive paper sheets into corresponding adjacent bins.

According to still another feature of the invention there is provided, in combination, an electrophotographic copying machine and a paper sorter for sorting paper sheets delivered by said machine. The combination includes a plurality of stationary vertically stacked paper receiving bins, and transport means including a paper support belt common to both the copying machine and the sorter for moving the paper sheets along a path having a paper delivery portion for receiving the sheets within the copying machine. The paper delivery portion of said path is adapted to move the sheets to a transport junction within the sorter, and the transport means has a vertical portion adjacent the junction. A paper catch tray is attached to the sorter. A bypass transport is provided for moving paper sheets from the transport junction to the paper catch tray. A sort select gate is disposed at the transport junction, the gate having a sort position for effecting transfer of paper sheets from the paper delivery portion to the vertical portion of the transport means. The sort select gate also has a bypass position for effecting transfer of paper sheets from the paper delivery portion of the transport to the paper catch tray via the bypass transport. Means is provided for disposing the sort select gate in its bypass position when a malfunction is detected in the portion of the sorter associated with the vertical portion of the transport means. Means is also provided for disposing the sort select gate in its sort position when sorting of paper sheets delivered by the copier is desired, as indicated by a signal placing the sorter in a sort mode of operation. Means is also provided for disposing the sort select gate in its bypass position when the capacity of the sorter is exceeded, thus causing any excess paper sheets to be deposited in the paper catch tray. Gate means is disposed between the vertical portion of the transport means and the bins for deflecting successive paper sheets into corresponding adjacent bins.

The various features of the invention, including but not limited to those heretofore described, will be best understood by reference to the following description in conjunction with the accompanying drawings, in which.

Figure 1:
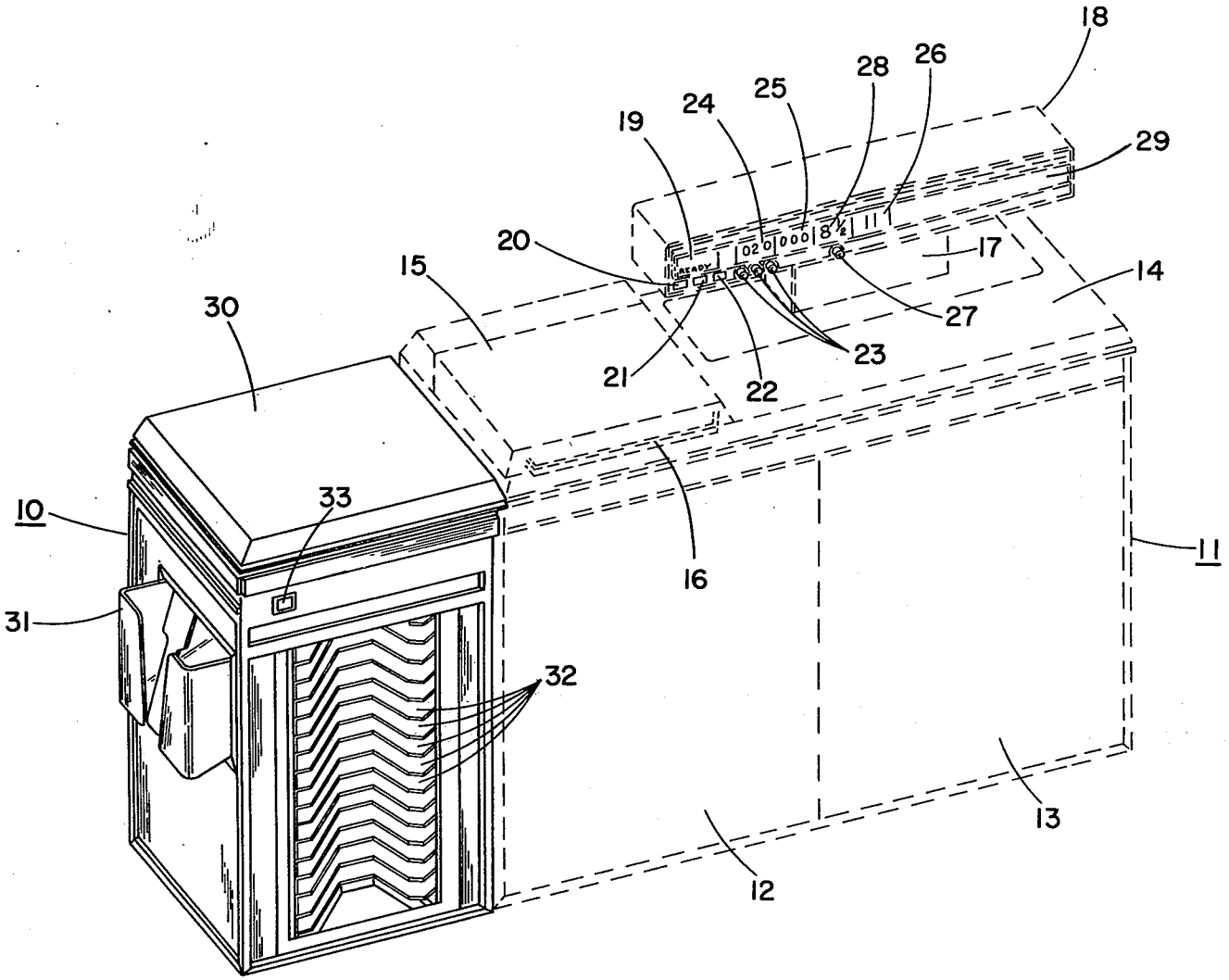
FIG. 1 is a perspective view of a sorter according to a preferred embodiment of the present invention, and includes a phantom view of a xerographic copier/duplicator with which the sorter is adapted to operate.

A sorter 10 according to a preferred embodiment of the invention is shown in FIG. 1, connected as an accessory unit to a xerographic copier/duplicator 11, the latter being shown in phantom view in FIG. 1.

The copier/duplicator 11 may be either sheet fed or roll fed and is capable of producing copies having a "length", i.e. dimension in the direction of paper movement, ranging from 5½ to 17 inches. The "width" of the copies produced by the copier/duplicator 11, i.e. the dimension transverse to the direction of paper movement, may range from 8 to 14 inches. The rate of paper movement through the copier/duplicator is typically on the order of 12 inches per second, and at this speed copies having a length of 8½ inches can be produced at the rate of approximately 4,000 per hour.

The copier/duplicator 11 has front access doors 12 and 13 which may be opened by a key operator for the purpose of clearing paper jams, or replacing toner cartridges. This machine has a top or "working" surface 14, upon which originals and copies may be placed. At the left side of the working surface 14 is a document cover 15, which is hinged at the rear and may be raised and lowered by means of a handle 16. An access door (not visible in FIG. 1) is provided at the right side of the copier/duplicator 11 for the purpose of changing or replacing the paper supply. Extending from the working surface 14 and supported by a pedestal 17 is a control console 18, which is hereafter described with reference to an embodiment of the copier/duplicator 11 which employs paper rolls.

At the left of the control console 18 is a relatively large "PRINT" button 19, which is momentarily depressed when it is desired to make copies. While the copier/duplicator 11 is warming up, a "NOT READY" signal flashes from within the PRINT button 19. After the warm-up phase is completed, the NOT READY signal goes off and a steadily illuminated "READY" signal appears. When the PRINT button is depressed, a "PRINT" signal within the button is illuminated, and remains illuminated during the time the copier is making copies. If for any reason it is desired to stop making copies during a run, this can be accomplished by pressing the "STOP PRINT" button 20.

Electric power to the copier is turned on by pressing the "COPIER ON" button 21.

A "LIGHT ORIGINAL" button 22 is provided for enhanced copying of pencil or other documents having relatively poorly reproducible print thereon.

The number of copies desired on a particular run, from 1 to 999, may be selected by means of the digital selection knobs 23 and the number of copies so selected is digitally displayed by the "COPIES SELECTED" digital readout 24. In FIG. 1, the readout shows that 20 copies have been selected.

The digital readout 25 indicates the number of "COPIES MADE" on a given run. When the PRINT button 19 is depressed, the digital readout 25 indicates the successive copies made by the copier/duplicator 11, the reading increasing until it reaches a value equal to the readout of COPIES SELECTED as indicated by the display 24. When the number of copies made is equal to the number of copies selected the machine cycles down, and thereafter the COPIES MADE readout 25 automatically resets to zero.

The "COPY WIDTH" digital readout 26 provides a visual indication and reminder of the width of the paper roll which has been installed in the machine. A "COPY LENGTH" control knob 27 enables selection of the desired length of the copies to be made, and is typically adjustable over a range of 5½ to 17 inches. The "COPY LENGTH" digital readout 28 provides a visual indication of the length which has been selected.

When a paper jam occurs in the copier, an internally-generated signal causes a "CALL KEY OPERATOR" light to flash in the signal area 29 of the panel of the control console 18. When the paper roll within the copier/duplicator 11 is exhausted, an "ADD PAPER" signal flashes on the signal panel 29. When the toner supply of the copier requires replenishment, an "ADD TONER" signal flashes on the signal panel 29.

The sorter 10 has a top or working surface 30 at approximately the same height as the working surface 14 of the copier/duplicator 11, to provide an additional area for the placement of originals and copies.

At the left side of the sorter 10 is an adjustable paper catch tray 31, which has an innermost position for copies having lengths up to 8½ inches, an intermediate position for copies having lengths greater than 8½ inches but not exceeding 14 inches, and an outermost position for copies having lengths in excess of 14 inches. A switch arrangement associated with the paper catch tray 31 prevents operation of the copier/duplicator 11 unless the copy length selected, as indicated by the readout 28, is compatible with the position of the paper catch tray 31.

At the front of the sorter 10 are 20 open bins 32, each bin being capable of storing 100 sheets of 20 pound bond paper. Thus the sorter 10 is capable of providing as many as 20 copies of a multi-page document consisting of up to 100 pages. Each of the bins 32 is capable of accepting copies having a "length" in the direction of paper travel of 8 to 8½ inches, and a "width" in the direction transverse to the paper travel direction, ranging from 8 to 14 inches.

A single operating button 33 is provided in the upper left area of the front panel of the sorter 10. Alternately depressing the mode selection button 33 switches the sorter 10 between its SORT and NON-SORT modes of operation. When the sorter 10 is in its SORT mode, the word SORT is illuminated within the button 33. When a paper jam occurs within the sorter 10, a light within the button 33 flashes repetitively.

Since the bins 32 are limited in storage capability to copies of 8 to 8½ inches in length, the sorter 10 is provided with logic circuitry to prevent it from going into the SORT mode if the copy length selected, as indicated by the readout 28, is other than 8 or 8½ inches. This requires, of course, that the paper catch tray 31 also be in its innermost position for operation in the SORT mode.

When the sorter 10 is in its SORT mode, it is capable of sorting up to 20 copies of any given original. Therefore, logic circuitry is provided to limit the number of copies per run made by the copier/duplicator 11 to 20 when the sorter 10 is in its SORT mode. Thus, in the SORT mode, the highest number of copies that can be made in each run is 20, and regardless of the positions of the selection knobs 23 and the indication of the COPIES SELECTED readout 24, no more than 20 copies per run will be made.

When the sorter 10 is in its NON-SORT mode, it acts merely as a conduit to transfer copies generated by the copier/duplicator 11 to the paper catch tray 31.

When it is desired to make copies which are not to be sorted, the operator first observes the condition of the sort mode selection button 33 and, if illuminated, presses it to cause the SORT light therein to go out and thereby place the sorter in its NON-SORT mode. Then the operator inserts a paper roll of the desired width into the copier/duplicator 11 by opening the right access door (not shown in FIG. 1) thereof.

After inserting the paper roll and closing the right access door, the operator raises the document cover 15 by lifting the handle 16 thereof, places the original to be copied on the platen (not shown) underneath the document cover, and closes the document cover. Thereafter the operator selects the desired number of copies (up to 999) by making the appropriate settings of the selection knobs 23. The operator then selects the desired copy length by means of the selection knob 27 and adjusts the position of the paper catch tray 31 to correspond to the copy length selected. Thereupon the operator depresses the PRINT button 19 and the copier/duplicator 11 will proceed to automatically make the selected number of copies, which copies will automatically be transported through the upper portion of the sorter 10 to the paper catch tray 31.

In the event a paper jam is detected by the copier/duplicator 11 in the course of making copies in the NON-SORT mode, the copier/duplicator will shut itself down, and the sorter 10 will continue to operate until it has delivered all paper sheets within it to the paper catch tray 31, at which time the sorter will cease operation.

In the event a paper jam is detected by the sorter 10 in its NON-SORT mode, the sorter will immediately shut down and will send a signal to the copier/duplicator 11 to cause it also to shut down.

If a paper jam is detected either by the copier/duplicator 11 or the sorter 10, the CALL KEY OPERATOR light will be caused to flash in the panel area 29 of the control console 18 of the copier/duplicator 11.

When operation in the sort mode is desired, the operator, after inserting a paper roll of the desired width and placing the original on the platen beneath the document cover 15 as previously described, selects the number of copies per run to be made, i.e. the number of sets of copies of the multi-page document to be reproduced. However, since there are only 20 storage bins 32, the logic circuitry of the sorter signals the copier to make no more than 20 copies per run in the SORT mode, as previously discussed.

After selecting the desired number of copies to be made, the operator sets the COPY LENGTH selector knob 27 to either 8 or 8½ inches. If any other copy length is selected, the sorter 10 will operate only in its NON-SORT mode The operator then adjusts the paper tray 31 to its innermost position, and presses the SORT mode selection button 33. This causes the SORT button 33 to become illuminated (if it was not already illuminated), indicating that the sorter is now in its SORT mode and is ready to receive copies from the copier/duplicator 11. Depressing of the SORT button 33 to place the sorter 10 in its sort mode enables certain internal operations to take place within the sorter 10, as will hereafter be described, including the movement of a sort select gate from its bypass position (in which copies from the copier/duplicator 11 are delivered directly to the paper catch tray 31) to a sort position in which copies from the copier/duplicator 11 are directed toward the paper receiving bins 32.

The operator then presses the PRINT button 19, and the copier makes the desired number of copies of the original which has been placed on its platen beneath the document cover 15. The first original to be copied should constitute the final page of the multi-page document to be reproduced, with subsequent runs being made from successive originals, the first page of the multi-page document to be reproduced being the last to be copied. As the copies of the original being reproduced are delivered by the copier/duplicator 11, they are received by the sorter 10 and delivered to the bins 32 face side, i.e. printed surface, up, one sheet being delivered to each bin, commencing with the uppermost bin. On successive runs, the copies of each original are likewise deposited in the same bins, so that after all originals have been copied, each bin utilized contains one complete copy of the original multi-page document.

If it is desired to stop making copies during a run, this can be accomplished by pressing the STOP PRINT button 20, causing the copier/duplicator 11 to cycle down. In this event the sorter 10 will sort the remaining copies delivered from the copier/duplicator 11, and reset itself so that upon resumption of operation of the copier the first copy received by the sorter will be delivered to its uppermost bin.

If, when the sorter 10 is in its SORT mode, a paper jam or other malfunction occurs within the copier/duplicator 11, the sorter will continue to sort whatever copies have been delivered to it, and will then "remember" not to reset itself until the run which has been interrupted has been completed. For example, if 20 copies per run have been selected by means of the selection knobs 23, and a paper jam in the copier/duplicator 11 results in only the first six bins of the sorter 10 being provided with copies, the control logic of the sorter will operate in such a manner that, upon clearing the copier malfunction and resuming operation, the next copy delivered to the sorter will be deposited in the seventh bin. Of course, upon clearing the malfunction in the copier, the operator should reset the selection knobs 23 to provide only the desired remaining number of copies.

Similarly, if a paper jam occurs in the portion of the paper transport apparatus of the sorter 10 which is adjacent the bins 32, the sort select gate within the sorter is automatically switched to its bypass position, so that the sorter continues to operate but in a NON-SORT mode with all subsequent copies being delivered directly to the paper catch tray 31. Simultaneously, the logic circuitry within the sorter causes the sort mode selection button 33 to start blinking, to provide a visual indication of the jam, and sends a STOP PRINT signal to the copier to cause it to cycle down. The control logic within the sorter prevents the sorter from resetting itself, so that upon clearing of the jam and resumption of operation the sorter finishes the sorting operation which was interrupted by the jam. As before, the operator should manually reset the selection knobs 23 to provide only the required remaining number of copies to complete the interrupted sorting operation.

If a malfunction is detected in the portion of the sorter transport mechanism which receives copies from the copier/duplicator 11 and delivers them to the vertical portion of the transport mechanism adjacent the bins 32, the logic circuitry causes all printing and paper transport operations in both the copier and the sorter to cease instantly, causes the CALL KEY OPERATOR light in the signal area 29 of the panel of the control console 18 of the copier/duplicator 11 to begin blinking, and prevents the sorter from resetting itself, so that, as in the previous situation, upon resumption of normal operation the sort sequence which had been interrupted can be completed.

If, after resuming normal operation upon clearing of one of the aforementioned types of paper jams, the operator forgets to reset the COPIES SELECTED knob 23 to provide only the desired remaining number of copies, the excess copies are deposited in the previously unused bins, and the copier/duplicator 11 may continue to deliver copies after the lowermost bin of the sorter has been filled. In this event the sorter logic circuitry will detect that the capacity of the sorter has been exceeded and will automatically cause the sort select gate to move to its bypass position, so that the excess copies received from the copier/duplicator 11 will be delivered directly to the paper catch tray 31.

To prevent additional internal jamming in the event any of the foregoing types of paper jams is detected, circuitry is provided to enable the sort select gate to move to its bypass position only when no paper sheets are traversing this gate.

An alternative way to provide the required remaining number of copies when a run has been interrupted is to simply observe the COPIES MADE readout 25 and press the STOP PRINT button 20 when the number of copies made corresponds to the additional number of copies required.

A jam which results in copies remaining within the copier/duplicator 11 may be cleared by opening the copier access doors 12 and 13, and removing any copies found within the copier.

Paper jams resulting in improperly positioned copies within the sorter 10 are cleared by (1) opening the front panel of the sorter and removing any observable improperly positioned copies, (2) sliding the top cover of the sorter to the left, pulling the release knob thus revealed upward, and swinging the entire sorter back upon its rear supporting hinges. This provides access to substantially the entire paper path of the sorter, so that all paper improperly found therein may be removed.

Figure 2:
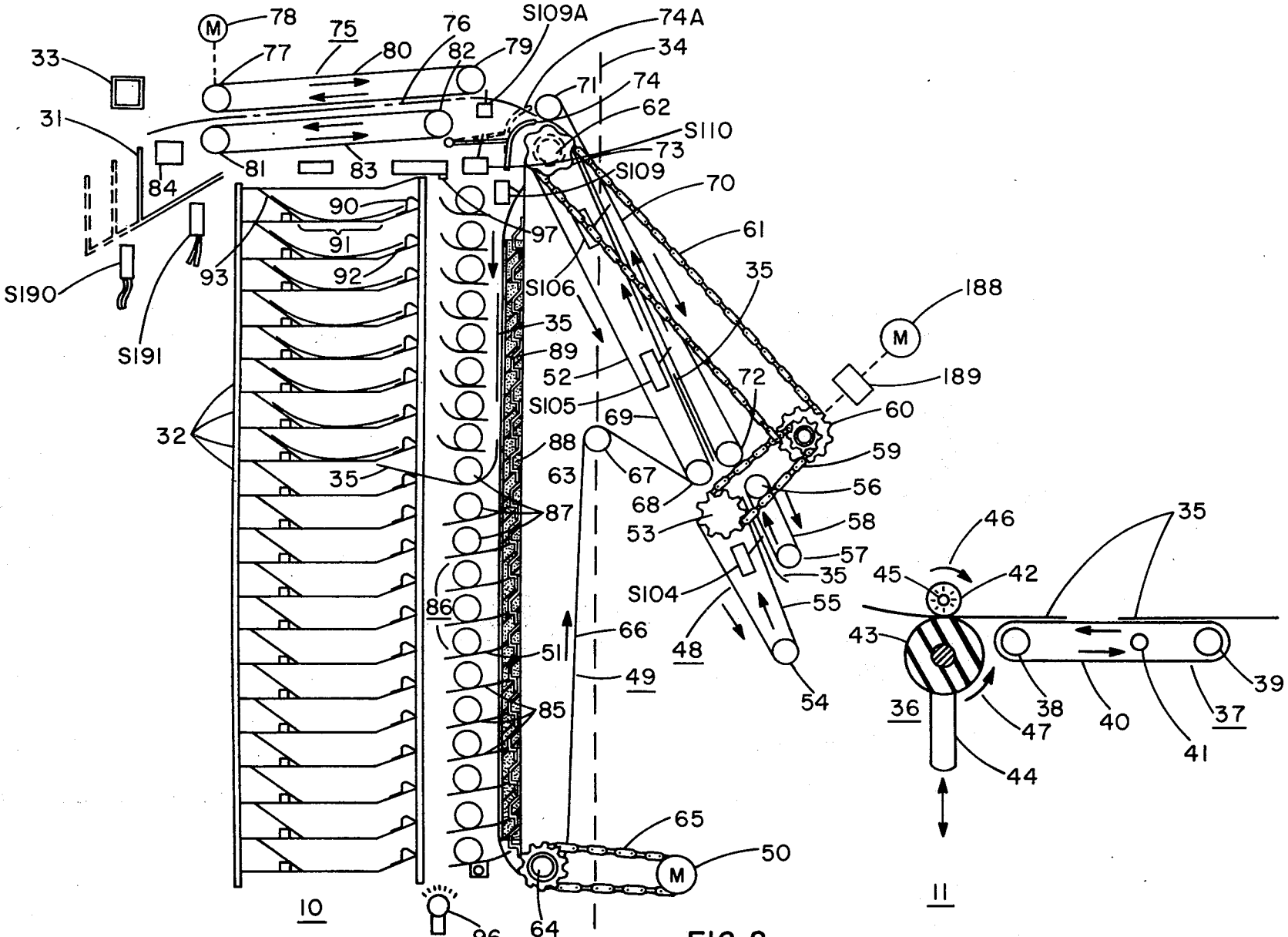
FIG. 2 is a functional schematic diagram of the sorter shown in FIG. 1.

The manner in which copy sheets are delivered by the copier/duplicator 11 to the sorter 10 and thereafter routed (1) to the paper catch tray in the NON-SORT mode or (2) to successive ones of the bins 32 in the SORT mode, will be best understood by reference to FIG. 2 of the drawing, which illustrates the overall operation of the sorter in functional schematic fashion.

In FIG. 2 the dashed line 34 corresponds to the dividing line between the sorter 10 and copier/duplicator 11, so that apparatus to the right of the line 34 is disposed within the cabinet of the copier, while apparatus to the left of said line is disposed within the cabinet of the sorter.

By means of xerographic processes well known in the art and therefore not described herein, the copier/duplicator 11 provides, on plain paper sheets 35 cut to the desired length within the copier, patterns of electroscopically adherent toner particles arranged in accordance with the print to be reproduced. These toner coated sheets, having the toner particles disposed on the upper surfaces thereof, are transported to a fusing assembly 36 by a vacuum transport 37.

The transport 37 comprises a drive roller 38, driven roller 39, and a non-conductive flexible belt 40 surrounding said rollers and driven thereby. The belt 40 is perforated to permit air movement therethrough, and a partial vacuum is maintained within the interior of the belt by means of a suitable vacuum source coupled to said interior through a conduit 41. The resulting suction force causes the lower surfaces of the paper sheets 35 to adhere to and be transported by the upper portion of the belt 40.

The purpose of the fusing assembly 36 is to permanently fuse the thermoplastic toner particles to the paper sheets 35 by means of heat and pressure. The fuser assembly 36 comprises a relatively rigid, heated pressure roller 42 and a relatively resilient fuser roller 43. A fuser jack rod 44, driven by a suitable reciprocating mechanism (not shown), presses the fuser roller 43 against the pressure roller 42 only while copies are being made, so as to prevent the formation of a groove or "set" in the pressure roller 43, and to avoid an excessive accumulation of the oil with which the rollers 42 and 43 are coated.

The pressure roller 42 is hollow and is heated internally by radiation from an axially positioned heat lamp 45. The pressure and fuser rollers 42 and 43 are caused to rotate in the directions indicated by the arrows 46 and 47 respectively, by means not shown in FIG. 2. The speed of rotation of the rollers is such that the peripheral speeds of the rollers at the region of contact thereof are equal to each other and to the linear speed of the transport 37, i.e. 12 inches per second in the specific embodiment herein described.

The pressure of contact between the rollers 42 and 43 causes a slight indentation or contact arc in the fuser roller 43, which is required to insure a sufficient contact area between the roller 42 and the paper sheets 35 to provide good fusing. The heat and pressure transferred to the paper sheets 35 by the rollers 42 and 43 softens the toner particles on the upper surfaces of the sheets, and causes them to firmly and permanently adhere to the underlying sheets. A suitable wick (not shown) provides a coating of oil on the surface of the pressure roller 42, which acts to minimize the tendency of toner particles to adhere to said roller.

The action of the fuser assembly 36 causes the paper sheets 35 passing therethrough to have a tendency to curl upward, i.e. to assume a concave configuration. This tendency is due in part to the nip through which the sheets pass at the region of contact of the pressure and fuser rollers, and in part to the evaporation of moisture from the upper surface of each sheet, causing said upper surface to shrink slightly with respect to the lower sheet surface.

After leaving the fuser assembly 36, the finished copies, i.e. the sheets 35, enter a transport assembly comprising a relatively small transport 48 and a relatively large transport 49.

The relatively large transport 49 is driven by a motor 50 which is electrically associated with the sorter. The transport 48 is independently driven by a motor 188, which is electrically and physically associated with the copier/duplicator 11, through an overrunning clutch 189. This clutch permits the transport 48 to be manually operated to clear paper jams, as hereinafter described, without having to overcome the inertia and frictional forces associated with the motor 188 and the other mechanisms of the copier/duplicator 11 coupled thereto.

The transport 49 has a vertical downwardly moving portion 51 (comprising two belts 66) situated entirely within the cabinet of the sorter 10, and an upwardly inclined portion 52 which extends from the cabinet of the copier/duplicator 11 into the cabinet of the sorter 10 across the dividing line 34.

The transport 48 comprises a drive roller 53, a driven roller 54, a plurality of belts 55 of resilient electrically conductive material mounted about the rollers 53 and 54 and driven thereby, and an upper idler portion comprising idler rollers 56 and 57 and a plurality of resilient nonconductive belts 58 mounted thereon. The drive roller 53 is caused to rotate by a chain 59, which is coupled to the motor 188 via a sprocket gear arrangement 60 and overrunning clutch 189. This rotation of the drive roller 53 causes movement of the belt 55 and, by frictional coupling between the belts 55 and 58, causes corresponding movement of the belt 58 and rotation of the idler rollers 56 and 57. The speed of movement of the belt 55 and, by frictional coupling, the belt 58, is substantially equal to the peripheral speed of the rollers 42 and 43, i.e. 12 inches per second.

As the paper sheets 35 leave the fuser assembly 36, they impinge upon the upper portion of the belt 55 and are frictionally engaged between the upper portion of the belt 55 and the lower portion of the belt 58, whereupon said sheets are moved upwardly by the transport 48.

A switch S104 is positioned adjacent the upper portion of the support belts 55, and has an actuating lever which extends between adjacent belts into the path of the paper sheets 35, so that the sensing lever of the switch S104 is depressed upon engaging the leading edge of a sheet, and is released upon disengaging from the trailing edge thereof. When the sorter 10 is operating in its SORT mode, switch S104 plays a role in controlling the beginning and end of the SORT run, as will hereafter be described.

The transport 49 comprises two resilient conductive belts 66 disposed about rollers 62, 64, 67 and 68 and driven through roller 64 by a motor 50 via chain drive 65. The upper portion 52 of transport 49 comprises an additional series of resilient belts 69 disposed about rollers 62 and 68. Another series of belts 70 is disposed about rollers 71 and 72 and driven by frictional engagement with the upper surface of the belts 69.

The linear speed of movement of the belts 66, 69 and 70 of the transport 49 is substantially greater than that of the transport 48, and may typically be on the order of 38 inches per second in cases where the linear speed of movement of transport 48 is on the order of 12 inches per second.

Switches S105 and S106 are disposed adjacent the upper surfaces of the belts 69, and have actuating levers which extend between adjacent belts to engage and be actuated by the paper sheets 35 as they traverse said levers. Switch S105 acts to detect static paper jams by operating a logic circuit which senses when said switch has been depressed for an excessively long time. Switch S106 plays a role in the detection of paper jams and in the conclusion of a sort run, as will be hereafter described.

Paper sheets entering the upper portion 52 of the transport 49 are frictionally engaged by the upper portion of the belts 69 and the lower portion of the belts 70, and after being released by the transport 48 are moved upwardly at the aforementioned speed of 38 inches per second.

The frictional force with which the belts 69 and 70 grasp the sheets 35 is substantially less than the frictional force with which the belts 55 and 58 of the transport 48 grasp said sheets. Therefore as the leading portion of one of the sheets 35 enters the region between the belts 69 and 70 of the upper portion 52 of the transports 49, the trailing portion of the sheet is held by frictional engagement between the belts 55 and 58 of the transport 48, so that the sheet continues to travel at a speed determined by the transport 48, i.e. 12 inches per second, with the leading portion of the sheet slipping with respect to the belts 69 and 70. When the trailing portion of the sheet is released by the belts 55 and 58 of transport 48, the upper portion 52 of the transport 49 rapidly accelerates the sheet to the speed of movement thereof, i.e. 38 inches per second. This arrangement permits the sorter to operate at a constant paper movement speed of, e.g., 38 inches per second, substantially independent of the paper movement speed within the copier/duplicator 11, thus permitting the sorter to operate, without modification, with copiers of varying paper movement speeds.

A knob 73 is provided to permit manual rotation of the roller 62, thus facilitating manual movement of the various belts of transport 49, to enable the removal of paper sheets from the upper portion 52 thereof in the event of a paper jam. In order to permit rotation of the transport 48 (as well as the transport 49) by the knob 73, the roller 62 is coupled through an overrunning clutch (not shown in FIG. 2) to a chain 61, which is in turn coupled to the sprocket gear 60. The couplings associated with the chain 61 are such that the overrunning clutch is not engaged when the transport 49 is operating. However, when the sorter 10 and copier/duplicator 11 are shut down in order to clear a paper jam, and the knob 73 is manually rotated, the overrunning clutch coupled to the roller 62 and chain 61 is engaged, while the overrunning clutch 189 associated with the motor 188 and sprocket gear 60 is disengaged, so that the knob 73 causes movement of the transport 48 as well as the transport 49, thus causing any paper sheets on the former transport or the upper portion of the latter transport to become accessible for easy removal thereof.

As the paper sheets 35 being transported by the upper portion 52 of the transport 49 reach the top thereof, they are either directed toward the paper catch tray 31 or the bins 32, depending upon the position of the sort select gate 74. In FIG. 2 the sort select gate 74 is shown in its bypass position, and in phantom view as 74A in its sort position. In its bypass position, the sort select gate 74 is positioned below the line of travel of the paper sheets 35, so that the sheets are not diverted, but continue to travel until they enter the bypass transport 75, and are delivered thereby to the paper catch tray 31.

The line of travel of the paper sheets 35 along this bypass path is indicated by the broken line 76.

A switch S110 has an actuating lever which engages a portion of the sort select gate 74, so that the switch 110 provides a signal indicative of whether the sort select gate is in its bypass or sort position. Another switch, S109A, has an actuating lever disposed in the bypass paper path, and is utilized to detect paper jams and control the operation of the sort select gate 74, as will hereafter be described.

The bypass transport 75 comprises a drive roller 77 driven by a motor 78, a driven roller 79, a flexible belt 80 surrounding the rollers 77 and 79 and driven thereby, lower idler rollers 81 and 82, and a flexible belt 83 surrounding said idler rollers. Paper sheets 35 entering the bypass transport 75 are frictionally engaged between the lower portion of belt 80 and the upper portion of belt 83 and transported thereby, at a speed of 38 inches per second, to the paper catch tray 31.

A high voltage alternating current corona discharge device 84 is positioned below the bypass paper path adjacent the paper catch tray 31. The purpose of the corona discharge device 84 is to substantially reduce or eliminate static electric charge which has built up on the paper sheets 35 so as to facilitate handling thereof and minimize the tendency of such sheets to stick to one another.

Sensing switches S190 and S191 are associated with the paper catch tray 31 to provide a signal, for control of the logic circuitry of the copier/duplicator 11 and sorter 10, so as to prevent operation of the copier/duplicator unless the paper catch tray 31 is in its proper position corresponding to the copy length which has been selected on the copier control console.

The following will summarize the operation of the sorter 10 in its NON-SORT mode.

In the NON-SORT mode, the maximum length of the paper sheets 35 corresponds to the longest copy length which can be selected by means of the copy length selection knob 27 on the control console 18 of the copier/duplicator 11, i.e. 17 inches in the specific embodiment herein described. This means that, at a speed of transport 49 and transport 75 of 38 inches per second, the time taken for the longest length copy to pass a given point in the paper path is slightly less than one-half second. Thus logic circuitry is provided to detect paper jams by monitoring switches S106 and S109A. If either of these switches remains depressed for more than one second, the logic circuitry indicates that a paper jam has occurred, and causes both the copier/duplicator 11 and sorter 10 to shut down immediately.

The distance, measured along the path of paper travel in the NON-SORT mode, between the switches S109A and S106 is selected to be less than the shortest copy length which can be selected by the selection knob 27 on the control console 18 of the copier/duplicator 11, i.e. less than 5½ inches in the specific embodiment herein described. To make sure that the paper is traversing its proper path in the NON-SORT mode, logic circuitry is provided to monitor the relative time of actuation of the switches S109A and S106. Since the distance along the paper path between the switches is less than 5½ inches, if the paper is traversing its proper path S109A must be actuated by one of the sheets 35 at the time S106 is deactuated by the passing of the trail edge of such sheet thereover. If this condition is not met, the sorter logic circuitry indicates that a paper jam has occurred, and causes the copier and sorter to shut down immediately.

Of course, upon placing the sorter 10 in its NON-SORT mode, the sort select gate 74 is allowed to assume its bypass, i.e. lower position.

When the SORT mode button 33 is depressed and released, so as to place the sorter 10 in its SORT mode, the sort select gate is raised to divert paper toward the bins 32 upon actuation of switch S104 of transport 48, when the actuating lever of the switch is depressed upon engagement by the leading edge of the first sheet of the copy run. The actuation of switch S104 causes the sort select gate 74 to shift to its upward or SORT position 74A, thus actuating the switch S110. The sorter includes a cam stack (not shown in FIG. 2) which continually seeks its "home" position until switch S104 is actuated by the lead edge of the first copy sheet of a sorting run. When the cam stack reaches its sort initiation or top bin position, a pulse is sent to a reset solenoid (not shown in FIG. 2), which operates a clutch to cause any of the 20 paper deflecting gates 85 which may be in their closed, i.e. clockwise rotated positions, to rotate to the open, i.e. counterclockwise rotated or paper-deflecting positions.

The gate and roller assembly 86 comprises a vertical array of 20 idler rollers 87, each idler roller having an outer conductive surface. Each of the paper deflecting gates 85 comprises a sheet metal deflecting element mounted coaxially with the corresponding one of the idler rollers 87. The details of this mounting arrangement will be hereafter described with reference to FIG. 9.

The particular arrangement of the gates 85 shown in FIG. 2 corresponds to a situation which exists at an interim point in a sort sequence. In the situation depicted in FIG. 2, a copy sheet has been deposited in each of the first eight of the bins 32, and a sheet 35 is in the process of entering the ninth bin. Therefore the first eight gates, having been actuated after the corresponding copies passed therethrough, are shown in FIG. 2 in their closed positions, and the ninth through twentieth gates are shown in their paper deflecting or open positions.

As previously described, actuation of switch S104 by the lead edge of the first sheet of a run causes all of the gates 85 to be reset to their paper deflecting or open positions. As the first sheet 35 moves along the transport 48 at a speed of 12 inches per second, its lead edge is grasped by the upper portion 52 of the transport 49, which is moving at 38 inches per second. However, because the paper is held more tightly by the transport 48 than by the upper portion 52 of the transport 49, the lead portion of the sheet slips with respect to said upper portion 52, until such time as the trailing portion is released by the transport 48. Thereupon the sheet is rapidly accelerated to 38 inches per second and actuates the switches S105 and S106 in succession. The lead edge then encounters the sort select gate 74, which is in its upper or sort position 74A. The sort select gate deflects the lead edge of the sheet 35, and causes it to progress downward between the vertical array of idler rollers 87 and the vertical portion 51 of the two belts 66.

Although, for clarity of illustration, a space is shown between the gate and roller assembly 86 and the vertical belts 51 (actually the vertically disposed portion of the belts 66), in actuality the belts 51 are in contact with the rollers 87, and are urged against said rollers by foam backing strips 88.

These foam backing strips 88 are supported by recesses in a vertical paper supporting structure 89 which has a corrugated configuration. The moving vertical strips 51 of the transport 49 are relatively narrow, and are urged against the idler rollers by the aforementioned foam backing strips, which are disposed in vertical slots in the paper supporting structure 89.

Figure 5:
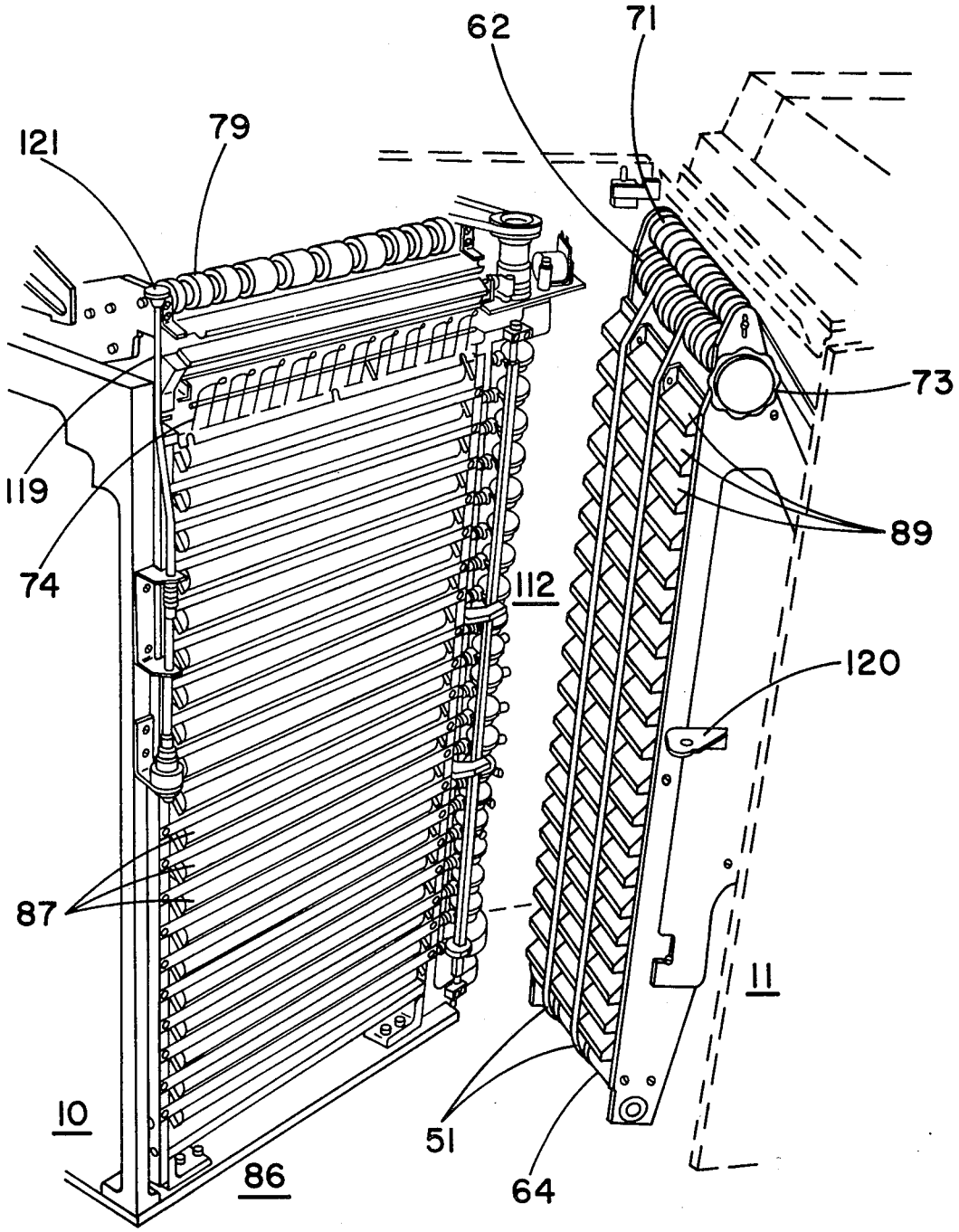
FIG. 5 shows a portion of the sorter of FIG. 1, with the sorter swung back on its supporting hinges.

The structural arrangement of the gate and roller assembly 86 and the paper supporting structure 89 will be more clearly evident by consideration of FIG. 5 in connection with the foregoing description. In FIG. 5, the sorter 10 is shown swung back on its rear hinges, so as to expose the region between the gate and roller assembly 86 and the paper supporting structure 89.

As the first paper sheet of the copy run is deflected downward into the sort area by the sort select gate 74, the lead edge of the sheet actuates switch S109. The lead edge then enters the region between the gate and roller assembly 86 and the paper supporting structures 89 and is frictionally engaged between the moving belts 51 and the idler rollers 87, which rollers are caused to rotate as a result of said frictional engagement.

In its open or paper deflecting position, the edge of each of the gates 87 adjacent the paper supporting structure 89 extends into a corresponding groove of the corrugated paper supporting structure 89. Each of said edges of the gates 85 has two cutouts or grooves for accommodating the vertical strips 51 without interfering therewith.

As the lead edge of the first sheet of the copy run encounters the first gate, the sheet is deflected by the gate into the top bin of the array of bins 32.

Upon entering the top bin, the lead edge of the copy sheet is deflected toward the top of the bin by an entrance guide lip 90. The lead edge of the sheet then moves along the top portion of the bin, with frictional contact with the top of the bin being minimized by means of two transverse ridges (not shown in FIG. 2) extending from the bottom surface of the top of the bin.

To utilize with increased efficiency the available height for the array of bins 32, each bin is provided with a generally concave configuration. Each bin has a horizontal center portion 91, an upwardly sloping side portion 92 adjacent the gate and roller assembly 86, and a deflectable upwardly sloping side portion 93 remote from the gate and roller assembly 86. This bin arrangement in effect provides a nested array of effectively concave bins, thus taking advantage of the tendency of the paper sheets 35 to curl, i.e. to assume a generally concave configuration in the arrangement shown in FIG. 2. The concave bin structure of the bins 32 thus provides considerably more paper storage capacity for a given overall height of the bin array, for sheets which have a tendency to curl into a concave shape, than would a conventional bin structure having bins of rectangular cross section.

Figure 3A:
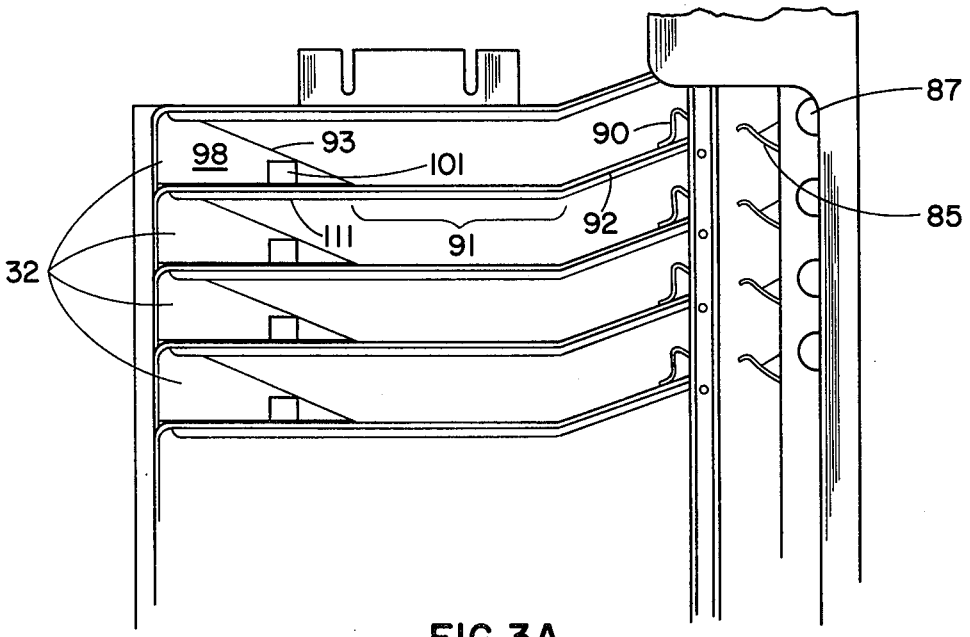
FIG. 3A is a front view of four of the paper receiving bins of the sorter of FIG. 1.
Figure 3B:
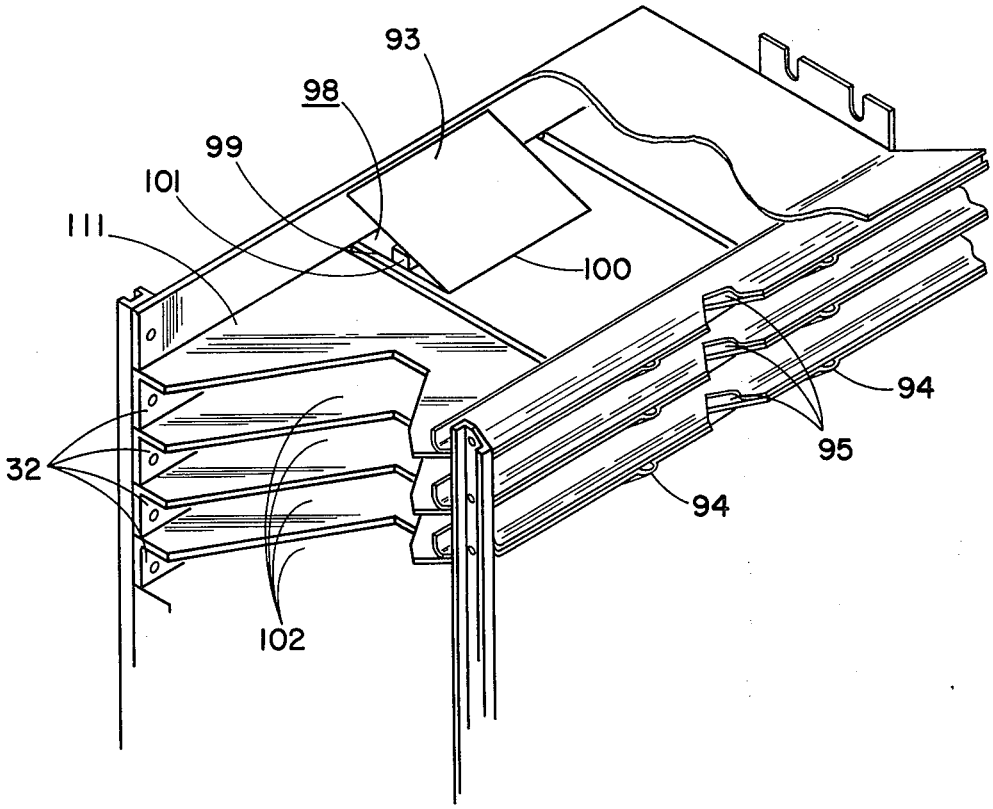
FIG. 3B is a perspective view of the bins shown in FIG. 3A.

As shown more clearly in FIGS. 3A and 3B, each of the bins 32 has two transverse ridges 94 extending from the lower surface of the top of the bin, so as to minimize frictional resistance to the movement of paper sheets into the bin. The bins 32 have vertically aligned notches 95, which permit an unobstructed path for the photoelectric system comprising the light source 96 and photosensitive element 97 (shown in FIG. 2).

The deflectable upwardly sloping side portion 93 of each bin is provided by a V-shaped member 98 having two relatively rigid walls 93 and 99 joined at the base 100 of the V, the walls 93 and 99 comprising a suitable spring material such as rigid vinyl plastic, and being capable of pivoting movement or folding with respect to one another, along the base line 100. A strip 101 of a resilient material such as foam rubber is disposed between the walls 93 and 99, to provide the desired resilient or deflectable characteristic of the wall 93.

Each of the bins 91 is provided with a cutout 102 at its front edge, to facilitate easy removal of sorted copies from the bins.

The lower wall 99 of each of the V-shaped members 98 is bonded to the surface of the support plate 103 of which the center portion 91 forms the lower part of each bin.

The purpose of the deflectable wall 93 of each of the bins 32 is to act as a "shock absorber" to slow down the rapid entry of copy sheets into the bins without creasing or otherwise damaging the sheets, and to aid in the orderly stacking of sheets within the bins.

As the leading edge of the first copy sheet traverses the corresponding, i.e. uppermost one of the gates 85, it intercepts the vertical photoelectric sensing path extending from the light source 96 to the photosensitive element 97, causing generation of a corresponding signal within the logic circuitry of the sorter 10. Similarly, after the first copy sheet has passed into the first bin, its trailing edge moves through the optical path of the photoelectric sensing circuit, permitting light from the source 96 to again reach the photosensitive element 97, and resulting in generation of a second signal within the logic circuitry of the sorter 10. This second signal causes the first gate to close, thus readying the sorter for routing of the next copy of the sequence to the second bin.

In similar fashion, the second sheet is deflected downwardly by the sort select gate 74, is transported by frictional engagement of the belts 51 with the idler rollers 87, and is deflected by the second gate into the second bin. After the trailing edge of the sheet has traversed the optical sensing path extending between the source 96 and photosensitive element 97, the second gate is rotated to its clockwise or closed position. In similar fashion, each successive copy is routed to a corresponding bin, until the copies are exhausted, i.e. no more copies are delivered by the copier/duplicator 11, and all copies previously delivered have been processed.

The successive actuations, i.e. closures of each of the paper diverting gates 85, are accomplished by indexing of a vertical cam stack 112 (not shown in FIG. 2) extending parallel to the gate and roller assembly 86, and having 19 cams, one cam for actuation of each of the first 19 bins. The 20th gate is fixed in its open position and does not require movement to a closed position, since copy sheets are never required to travel further than the 20th bin.

Each time the photoelectric circuit comprising the source 96 and sensor 97 detects the passage of the trailing edge of the copy therethrough, the cam stack 112 (shown in schematic form in FIG. 8 and partially visible in FIG. 7) is caused to rotate 1/20 of a revolution or 18°, so as to actuate the corresponding gate to cause it to rotate to its closed position.

When, as the sort sequence continues, and assuming that at least 19 copies have been selected, the 19th copy enters the 19th bin, an overfill switch S-103 (see FIG. 8) coupled to the cam stack 112 is actuated, causing the sort select gate 74 to shift down to its bypass position, thus causing all copies which have not yet passed the sort select gate 74 to be routed to the paper catch tray 31 by the bypass transport 75. The 20th copy, if present, would at this time be disposed at the sort select gate, and would therefore progress to the last gate, i.e. the fixed or 20th gate and be diverted into the 20th bin.

At the end of a copy run, i.e. when the copier/duplicator 11 has ceased delivering copy sheets 35 to the sorter 10, the end of the copy run is determined by the sorter logic circuitry by continuous monitoring of the times for which switches S104 and S106 remain depressed. When switch S104 has not been depressed for a period of two seconds and switch S106 has not been depressed for a period of one second, the sorter logic circuitry determines that the end of the run has been detected, and returns the sort select gate 74 to its lower or bypass position, and also causes the cam stack 112 to return to its initial or home position, whereupon all of the gates 85 are reset to their open positions.

The reset procedure at the end of each copy run, as set forth in the preceding paragraph, requires approximately three seconds. Therefore, when the copier/duplicator 11 completes a print sequence, the sorter sends a signal to the copier/duplicator 11 which prevents the copier from going into the next print sequence for three seconds.

In the event that a paper jam is detected by the sorter, or a signal is generated by the copier/duplicator 11 indicating that a malfunction has occurred therein (or that the copier has run out of paper), return of the cam stack 112 to its home position is inhibited, so that upon resumption of normal operation, the sort sequence which was interrupted by the malfunction may be completed.

Paper jams in the SORT mode are detected in a variety of ways. As in the NON-SORT mode, jams on the upper portion 52 of the transport 49 are detected by monitoring the switch S106, and a jam is signalled if this switch remains depressed for more than one second. To insure that the copy sheets are travelling on the proper path, switches S109 and S106 are monitored with respect to each other, the distance between the switches along the paper path being less than the shortest copy length to be sorted, i.e. 8 inches. Switch S109 must be actuated when switch S106 is released, and failure to meet this condition causes the sorter logic circuitry to signal a paper jam. In the event either of these conditions occurs, causing a jam to be signalled by the sorter logic circuitry, all printing is caused to cease immediately, and the CALL KEY OPERATOR signal light within the display area 29 of the console 18 of the copier/duplicator 11 will flash. Each of the switches S104 and S105 shown in FIG. 2 which remains covered by paper after transport operations have ceased will be identified by corresponding signal lights within the display area 29 of the copier control console 18.

The photoelectric sensing circuit comprising the light source 96 and photosensitive element 97 (said sensing circuit being hereafter sometimes referred to as the "eye") also plays a role in the detection of paper jams. If the photoelectric path is interrupted for more than one-half second, the sorter logic circuitry signals that a so-called "non-emergency" paper jam has occurred, and sends a STOP PRINT signal to the copier/duplicator 11, which thereupon cycles down. At the same time, the sorter logic circuitry causes the sort select gate 74 to be lowered to the bypass position, so that all remaining copies are diverted to the paper catch tray 31 by the bypass transport 75. The sorter logic circuitry also prevents the cam stack 112 from rotating, so that the gates 85 are not reset, and, upon clearing the jam and resuming normal operation, the sort sequence which had been interrupted may thereby be completed.

The sorter logic circuitry monitors the time relationship between the switch S109 and the eye, to insure that the leading edge of the first copy sheet of each sort sequence crosses the eye within one second after it actuates switch S109. The logic circuitry also monitors the time duration of crossings of the eye by the leading edges of successive sheets, and indicates a paper jam if said time duration exceeds one second. Each of the aforementioned types of paper jam is treated as a non-emergency jam, and results in system operation as described in the preceding paragraph.

When a malfunction occurs in the copier/duplicator 11, so that it is caused to generate an "out of service" signal, during a sort sequence, the sorter operates normally, except that it does not reset until the run has been completed after the "out of service" condition has been cleared.

Figure 4:
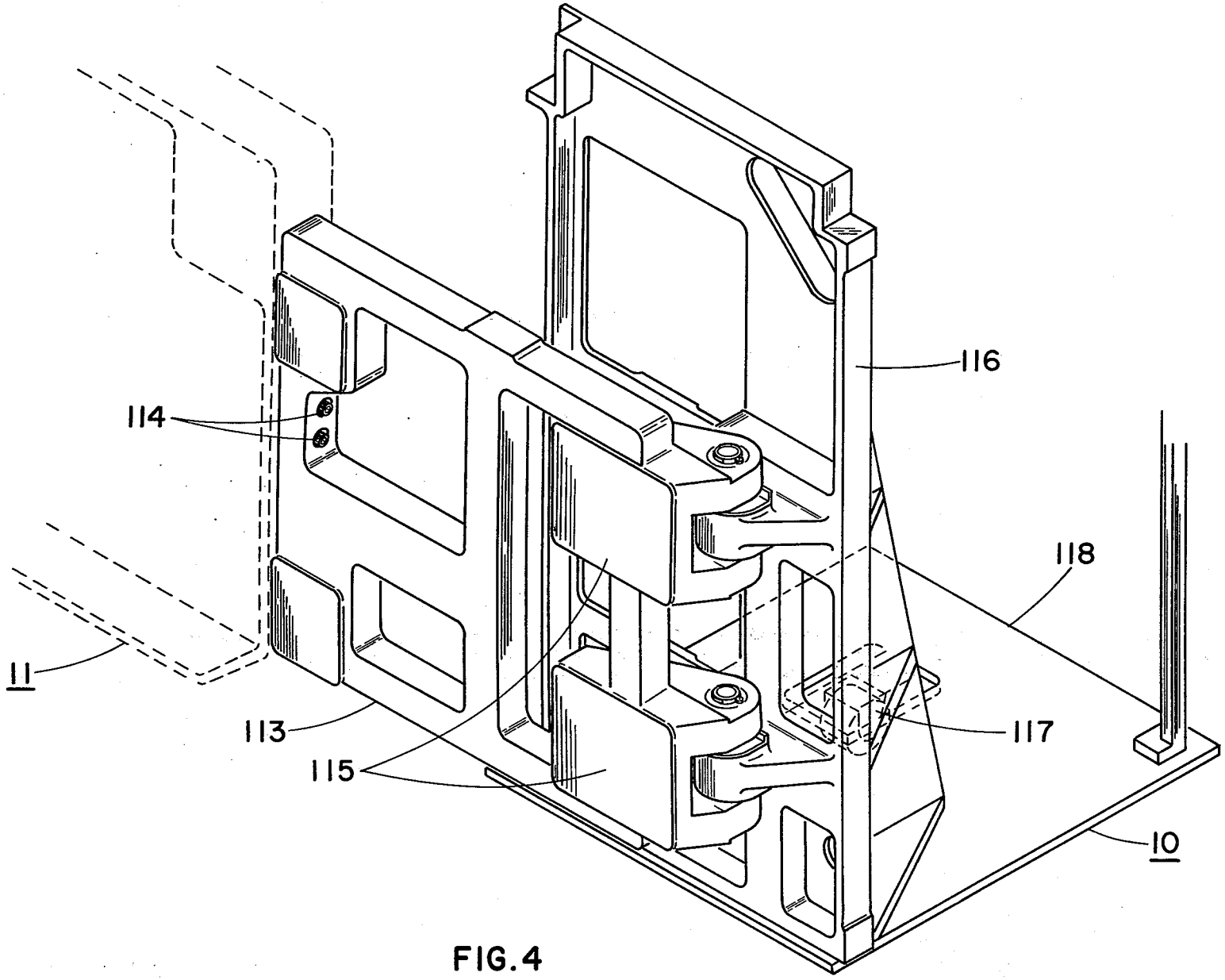
FIG. 4 is a rear perspective view showing a portion of the supporting frame of the sorter of FIG. 1.

The manner in which the sorter 10 may be swung out on its supporting hinges to expose the area between the gate and roller assembly 86 and the paper supporting structure 89 is illustrated in FIG. 4, which shows a rear perspective view of a portion of the sorter frame, with the adjacent portion of the frame of the copier/duplicator 11 being shown in phantom view.

As shown in FIG. 4, a rear casting 113 is secured at one end to the adjacent portion of the main casting of the copier/duplicator 11 by means of bolts 114. The opposite end of the casting 113 comprises two hinges 115, to which the rear support casting 116 of the sorter 10 is pivotally secured. This arrangement provides accurate spacing and alignment of the sorter 10 with respect to the copier/duplicator 11.

The sorter 10 is supported on the floor upon which it rests by means of a single wheel 117 secured to the underside of the sorter bottom support plate 118. In its operating position, the sorter 10 is in the position shown in FIG. 4, and is pivotally secured in said operating position by the engagement of a latch rod 119 (shown in FIG. 5) with a hole in the latch plate 120, which plate is secured to the front side member of the transport mounting bracket.

When the sorter 10 is to be swung out on the hinges 115 to facilitate the clearing of paper jams or other service operations, the latch knob 121 (FIG. 5) is pulled upward to disengage the latch rod 119 from the latch plate 120, and the sorter 10 is rolled back on the wheel 117, i.e. pivoted about the hinges 115 to expose the desired region.

Various interlock switches provide a safety feature by preventing operation of the sorter 10 or copier/duplicator 11 when the sorter panels are opened.

Figure 6A:
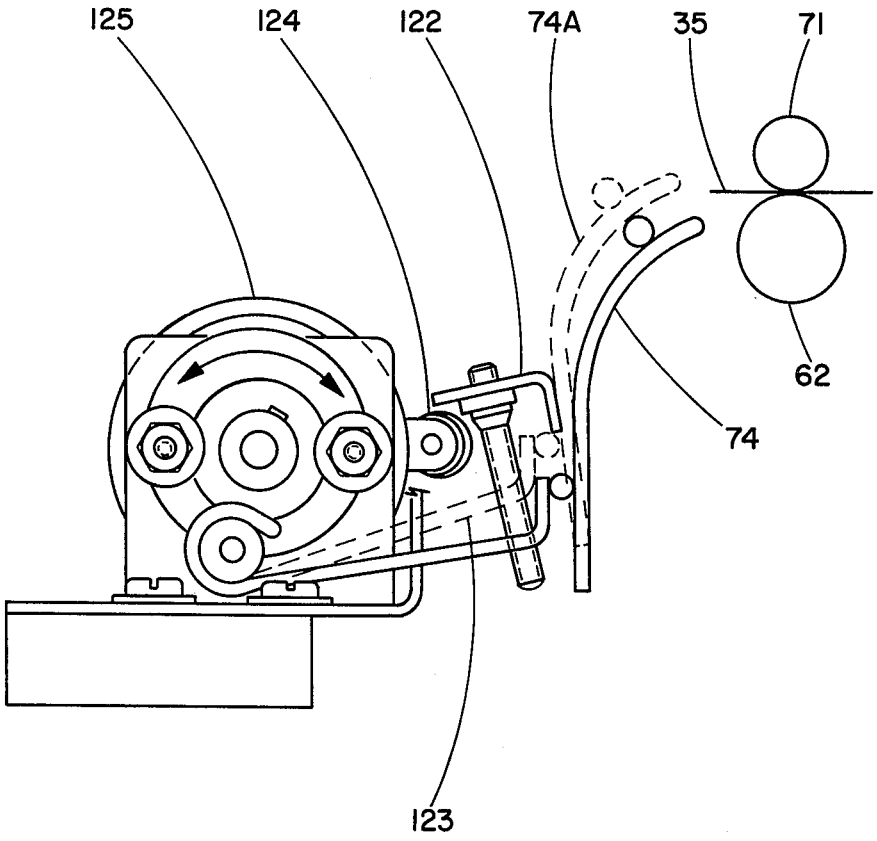
FIGS. 6A and 6B show the mechanism for moving the sort select gate of the sorter shown in FIG. 1.
Figure 6B:
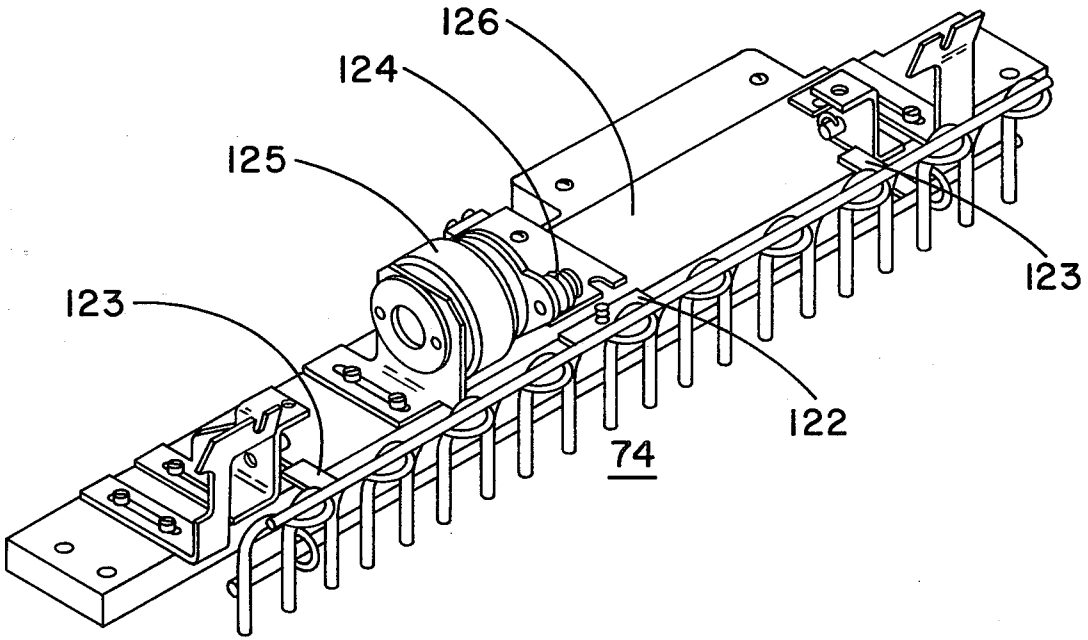

The operation of the sort select gate 74 will be more clearly understood from FIGS. 6A and 6B. FIG. 6A shows a side view of the sort select gate 74 and its operating mechanism, while FIG. 6B shows a perspective view thereof.

As shown in FIG. 6A, a bracket and pin arrangement 122 is secured to the sort select gate 74. A cam member 124 coacts with the pin and bracket assembly 122 to define the upper (sort position) and lower (non-sort or bypass position) operating positions of the sort select gate 74. In FIG. 6A the gate 74 is shown by solid lines in the bypass position and in phantom view for the sort position.

The cam 124 is coupled to the rotary solenoid 125, so that upon actuation of the solenoid 125, it is caused to rotate counter-clockwise, thus raising the sort select gate to its sort position. When the sort select gate is to be returned to its bypass position, the solenoid 125 is deactuated, the weight of the sort select gate 74 causing the gate to move down to its bypass position and rotating the solenoid 125 clockwise.

A high voltage alternating current corona discharge device 126 is positioned adjacent the sort select gate 74, for the purpose of substantially reducing or eliminating static electric charge on the paper sheets 35 which are directed toward the bins 32 during each sort sequence. The sort select gate 74 has an open wire structure so that the static eliminator 126 can reduce or eliminate static charges on the paper sheets 35, by operating through the apertures in the gate 74.

It has been found that, for proper static elimination action, an air gap is required between the sort select gate 74 and the paper sheets passing by said gate, in the vicinity of the static eliminator 126, and this air gap is provided by proper dimensioning of the gate 74 and alignment thereof with the adjacent portion of the upper part 52 of transport 49.

The manner in which the cam stack 112 is indexed and reset to provide the desired operation of the gates 85 is shown in detail in FIGS. 7 through 12.

Figure 7:
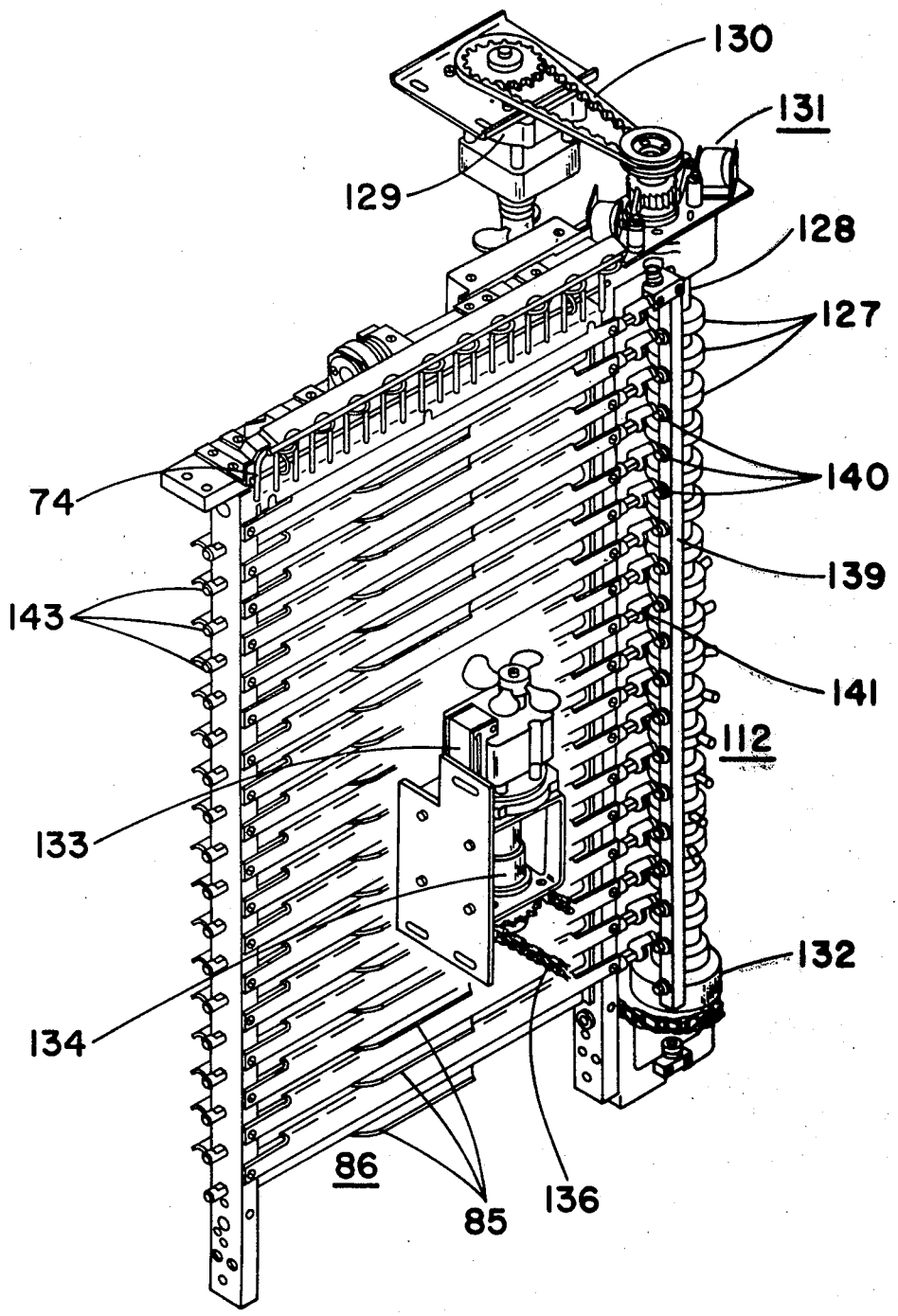
FIG. 7 is a perspective view showing the paper deflecting gates and the cam stack of the sorter shown in FIG. 1.
Figure 8:
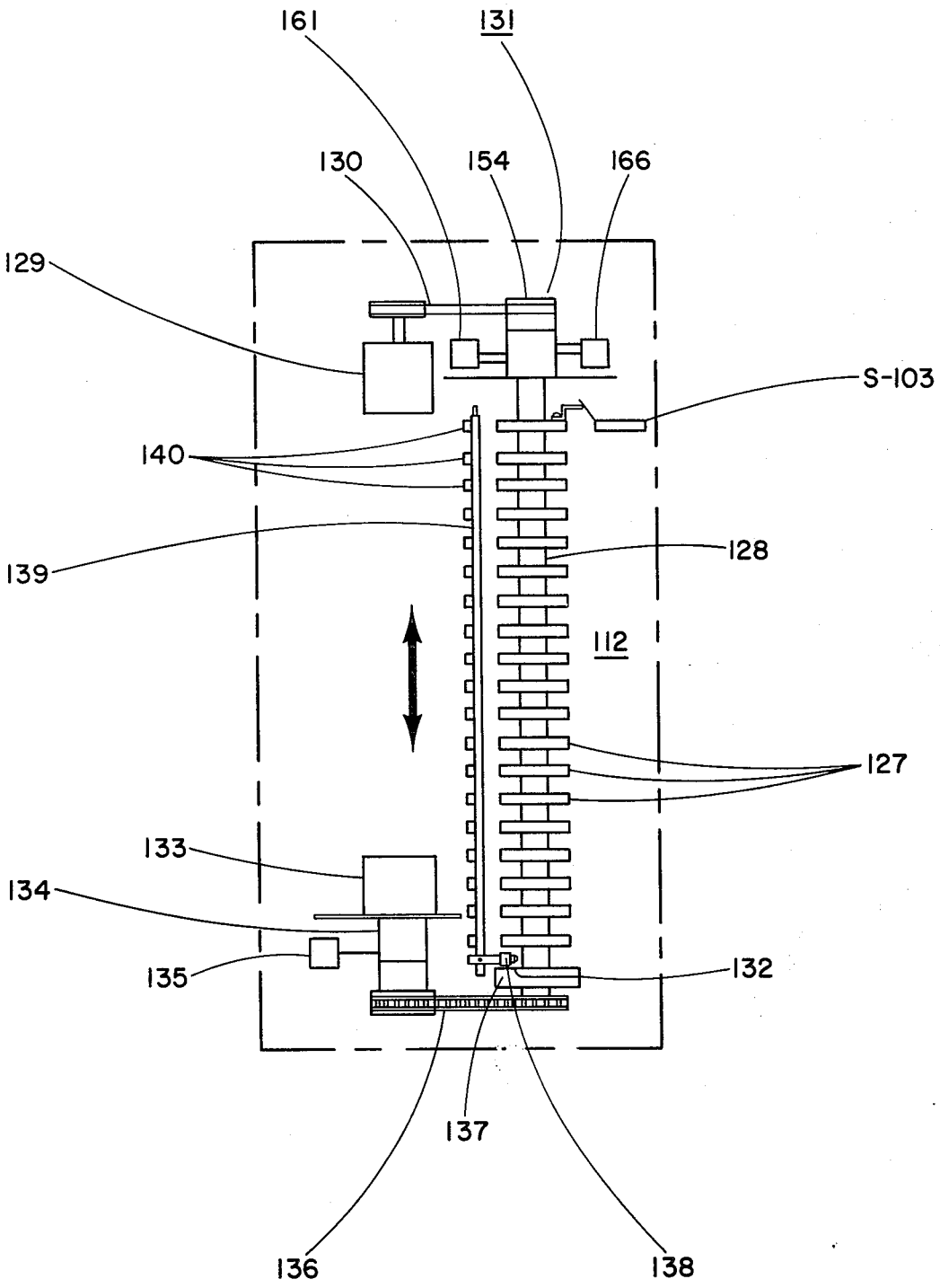
FIG. 8 is a functional schematic diagram of the cam stack arrangement of the sorter shown in FIG. 1.

As shown in FIG. 7, the cam stack 112 comprises 19 indexing cams 127 mounted for concurrent rotation on a splined shaft 128 which extends through all 19 of the cams 127. The shaft 128 has 20 longitudinal splines, spaced 18° apart, with successive ones of the cams 127 being rotationally displayed 18°, or 1 spline, from one another.

Rotational torque for indexing the shaft 128 and cams 127 mounted thereon is provided by a cam motor 129 via a toothed belt drive 130 and indexing mechanism 131. Mounted coaxially with the shaft 128 at the bottom thereof, but rotatable independently of said shaft 128, is a reset cam 132. This reset cam 132 is driven by a reset motor 133 through a clutch assembly 134, which is controlled by a reset solenoid 135, and a chain drive 136.

During the reset sequence, both the shaft 128, with its associated cams 127, and the reset cam 132 are caused to rotate to their home position. However, the shaft 128 rotates at a higher angular velocity than the reset cam 132, so that all of the cams 127 have returned to the home position and halted thereat by the time the raised portion 137 of the reset cam 132 engages the reset cam follower 138 to raise the push rod reset assembly 139, so as to cause the gates 85 to be reset to their open positions.

Disposed along the push rod reset assembly 139 are 19 reset protuberances 140, each reset protuberance being disposed adjacent to a corresponding one of the gate release cams 127.

Figure 9:
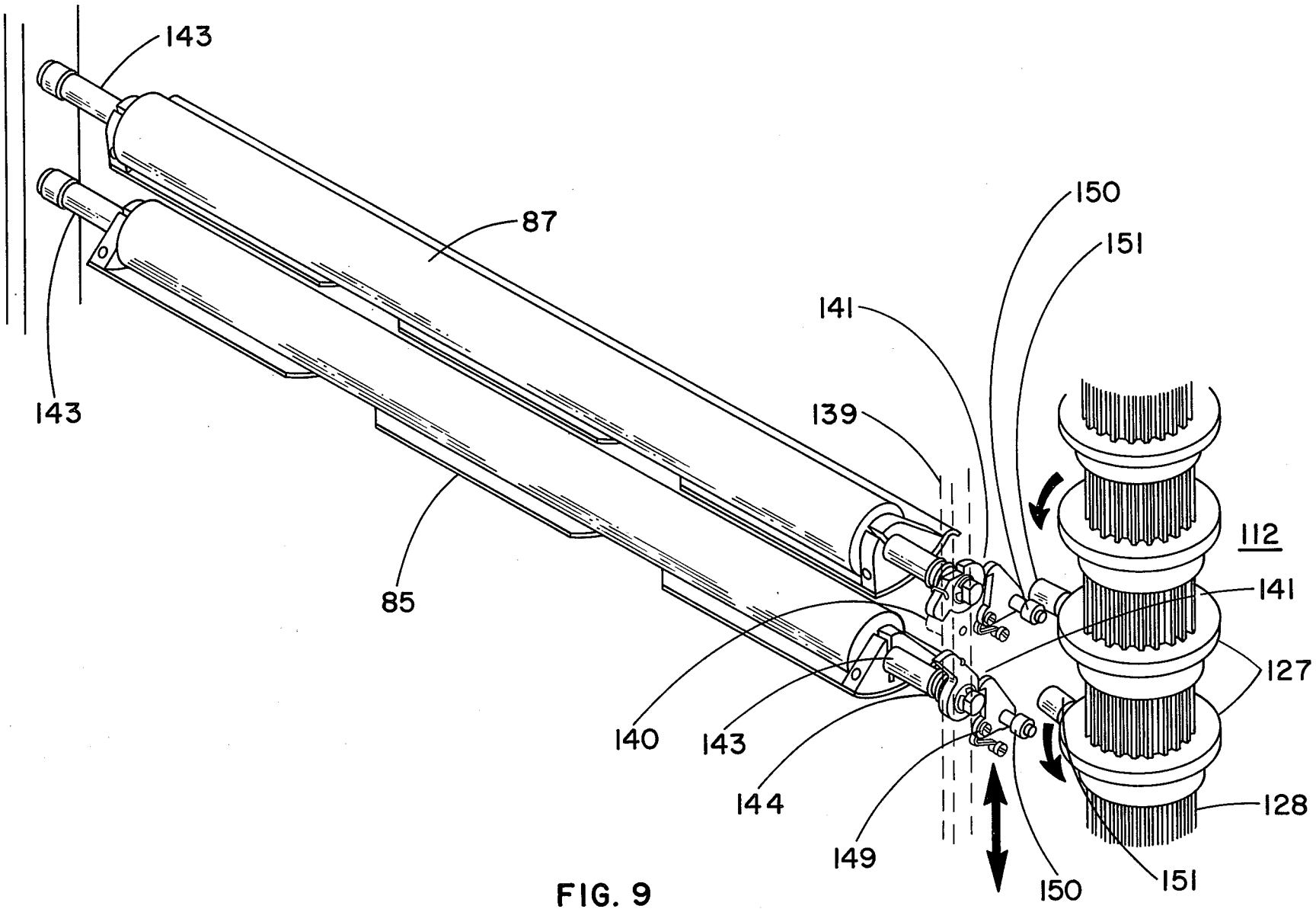
FIG. 9 is a perspective view showing two adjacent paper deflecting gates and guide rollers of the sorter shown in FIG. 1, with the adjacent parts of the cam stack and gate latching mechanisms.
Figure 10:
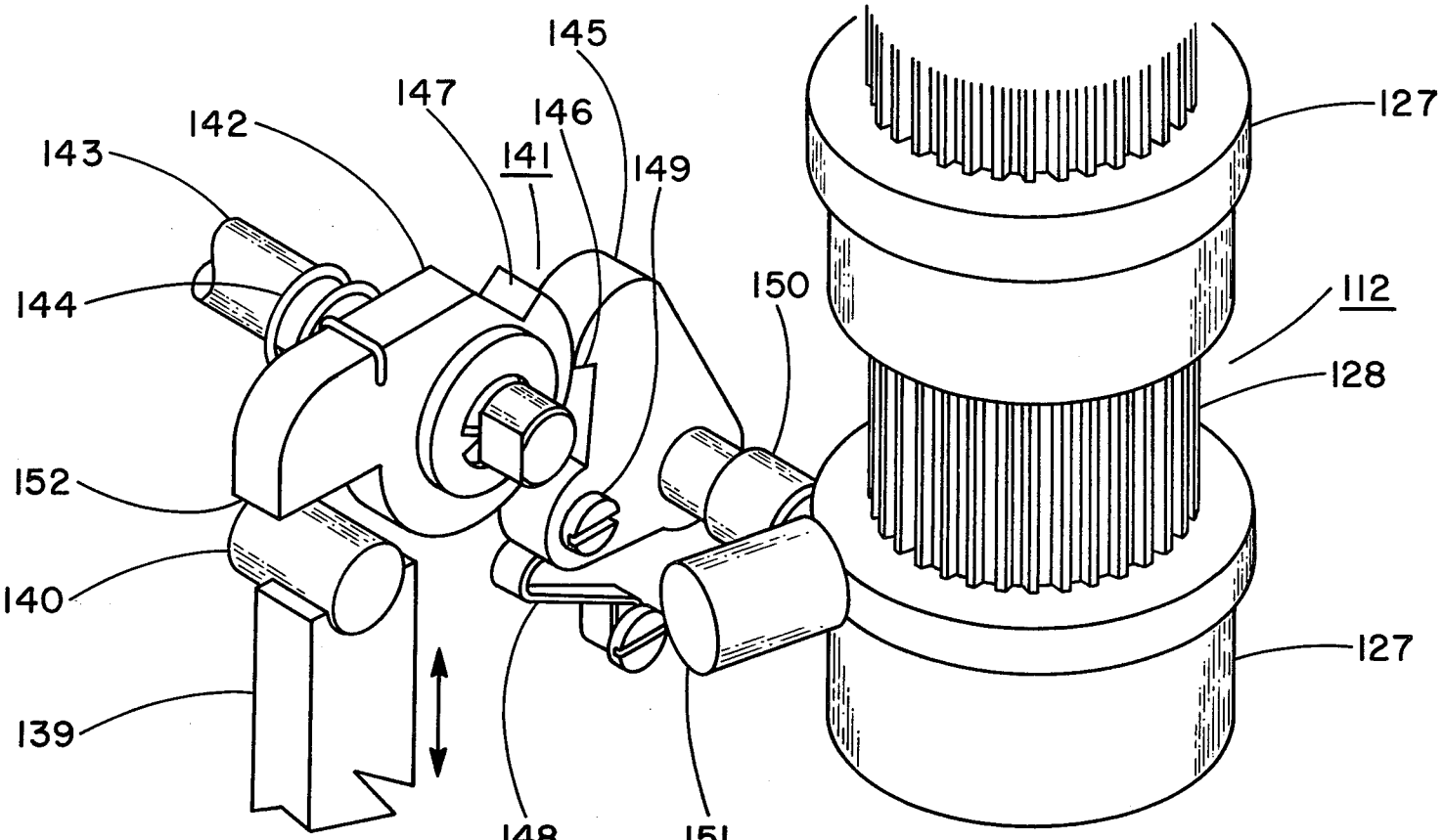
FIG. 10 is a detailed perspective view of one of the latching pawl mechanisms associated with each of the paper deflecting gates of the sorter shown in FIG. 1.
Figure 11:
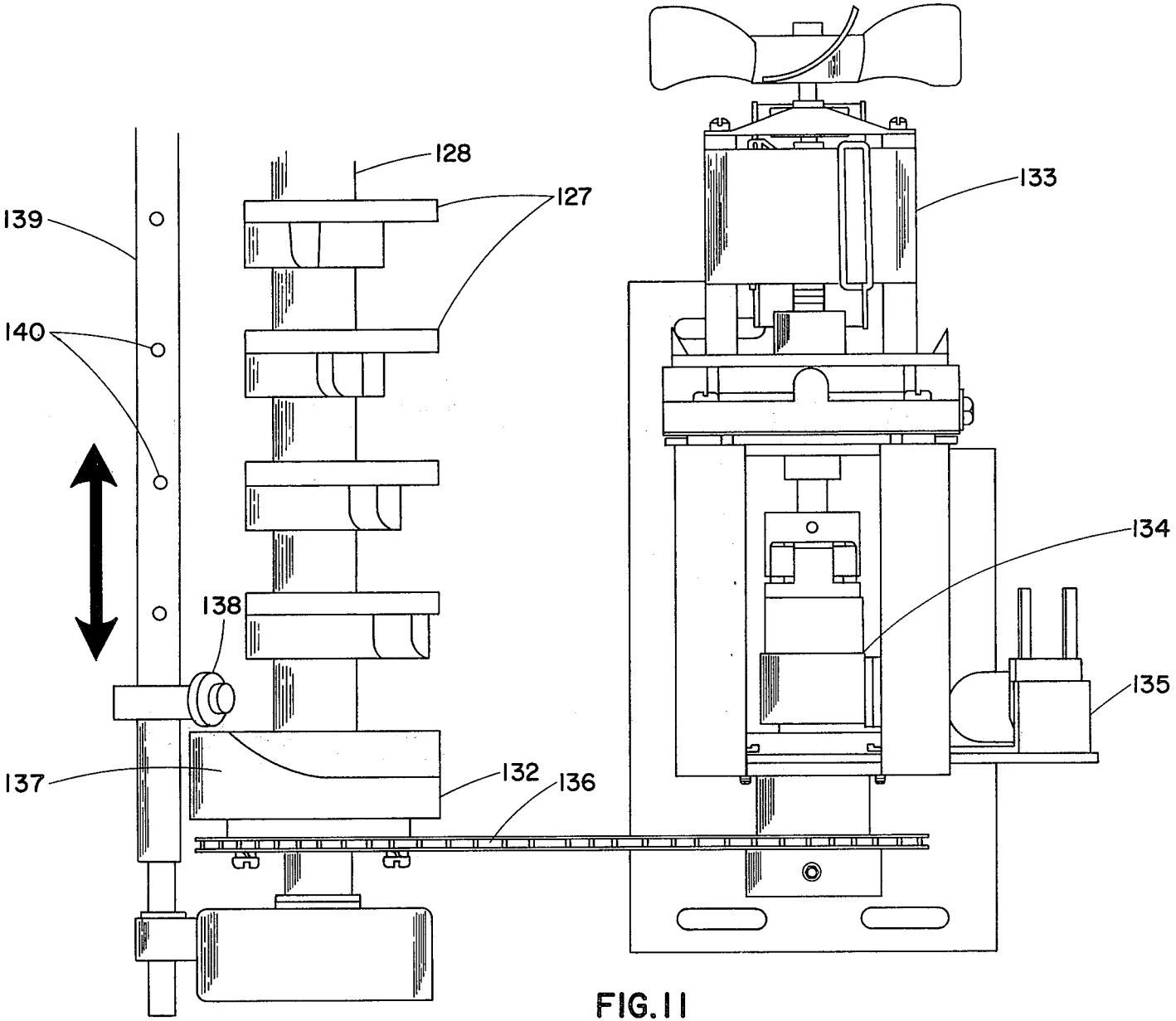
FIG. 11 shows, in functional form, the gate latch reset motor and push rod reset arrangement of the sorter shown in FIG. 1.

Associated with each of the gates 85 is a latch assembly 141, as shown in FIGS. 7, 9 and 10. As shown most clearly in FIG. 10, each of the latch assemblies 141 comprises a gate pawl 142 secured to the corresponding gate shaft 143, a gate spring 144 for urging the gate pawl 142 and shaft 143 toward the closed position of the gate, and a latch pawl 145 having a lip 146 for engaging a corresponding shoulder 147 of the gate pawl 142. A pawl spring 148 urges the latch pawl 145 in a direction to maintain engagement between the lip 146 of the latch pawl 145 and the shoulder 147 of the gate pawl 142, so that the gate pawl 142, once latched by engagement of the lip 146 with the shoulder 147, is maintained in the latched position by the pawl spring 148.

In FIG. 10 the latch assembly 141 is shown in the unlatched or closed position, i.e. with the corresponding gate 85 rotated clockwise as seen in FIG. 2. In FIG. 9 two adjacent gates, with their associated latch assemblies 141 are shown, with the upper latch assembly and gate in the unlatched or closed position and the lower latch assembly and gate in the latched or open position.

Each of the latch pawls 145 is pivotally mounted by means of a hinge pin 149, and has a cam follower 150 affixed thereto for engagement by a corresponding cam protuberance 151 affixed to the adjacent cam 127 mounted on the shaft 128.

Each gate is caused to move from its open to its closed position by indexing the shaft 128 so that the corresponding cam 127 and protuberance 151 engage the cam follower 150 of the associated latch pawl 145, thus causing the pawl 145 to rotate about the hinge pin 149, so that the lip 146 thereof disengages from the shoulder 147 of the corresponding gate pawl 142. Thereupon the gate spring 144 causes the pawl 142, gate shaft 143 and associated gate 85 to rotate to the closed position.

When the gates are to be reset to their open positions, the solenoid 135 is actuated, causing the wrap spring clutch 134 to engage, so that the reset motor 133, via the chain drive 136, rotates the reset cam 132 to cause the raised portion 137 thereof to engage the cam follower 138, thus moving the push rod assembly 139 upward, so that the cam elements 140 thereof engage the shoulder 152 of each gate pawl 142, thus rotating the pawl and associated gate shaft 143 and gate 85 until the shoulder 147 of the pawl 142 once again engages the lip 146 off the latch pawl 145, thus latching the gate in its open position again.

Thus it is seen that, upon indexing the shaft 128 as aforesaid, the cam stack 112 is caused to rotate 18° at a time, thus causing the gates 85 to be unlatched in sequence. At the end of each sort sequence the indexing assembly 131 rotates the shaft 128 of the cam stack 112 to its home position. At the same time, the reset cam 132 is caused to make a single rotation (at a lower angular velocity than that of the shaft 128), so that after the cams 127 have stopped at their home positions, the raised portion 137 of the reset cam 132 causes the push rod assembly 139 to move upward, thus simultaneously resetting or latching all of the gates 85 which had been unlatched during the preceding sort sequence.

This reset operation is initiated when the end of a run is sensed by the switches S104 and S106, as has previously been described. Upon sensing the end of the run, the reset solenoid 135 is momentarily actuated, causing the wrap spring clutch to engage for a single revolution of the clutch shaft and the reset cam 132.

Figure 12B:
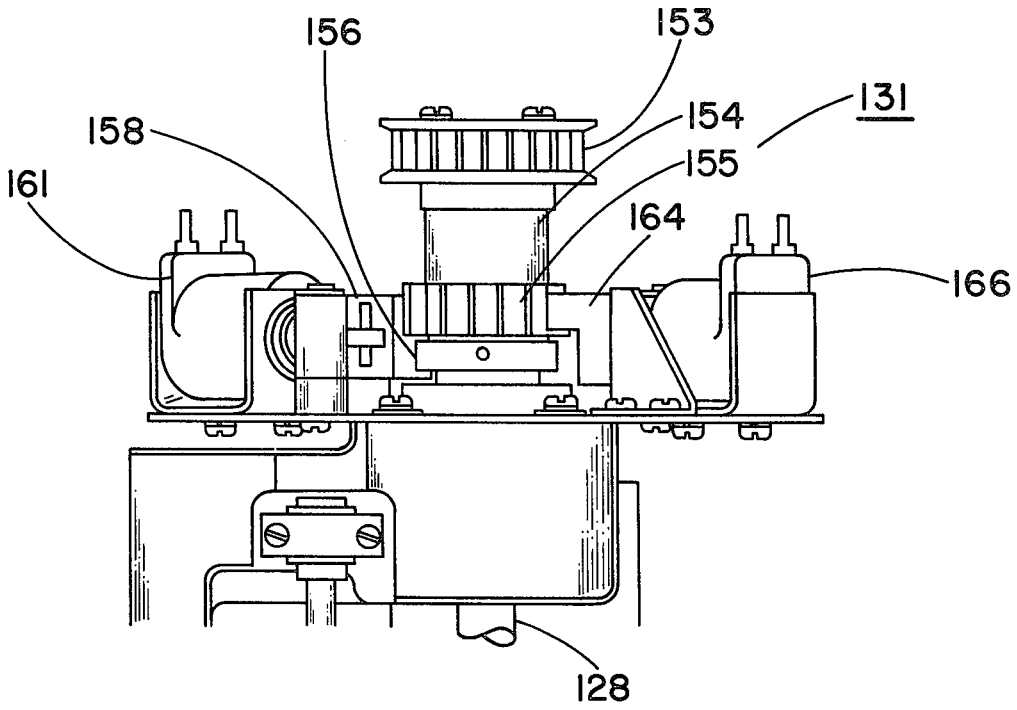
FIG. 12B is an elevation view of this indexing mechanism.
Figure 12A:
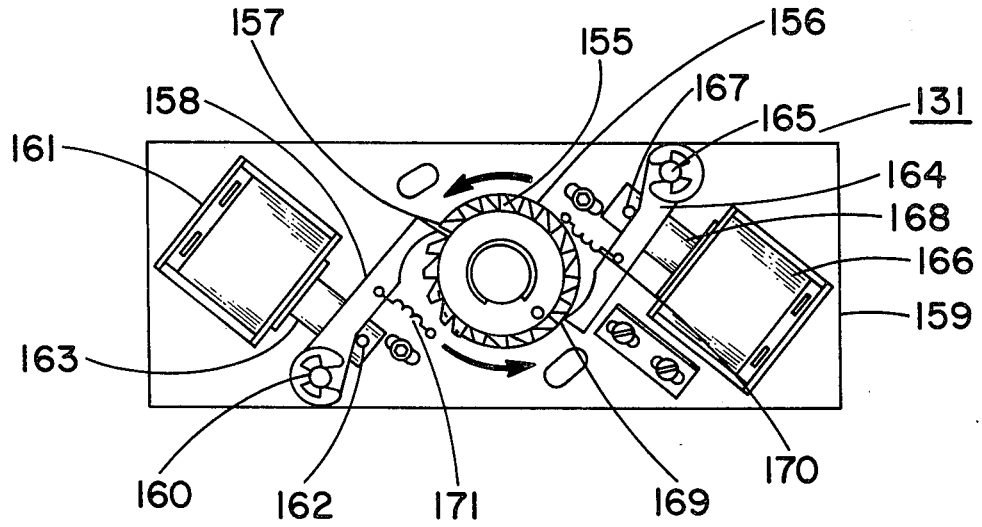
FIG. 12A is a plan view of the cam stack indexing mechanism of the sorter shown in FIG. 1.

The manner in which the indexing mechanism 131 operates to control the indexing and reset of the cam stack 112 will be best understood by reference to FIGS. 12A and 12B of the drawing.

As seen in FIG. 12B, the indexing mechanism 131 includes a timing pulley 153 at the top thereof, to which the belt drive 130 (FIGS. 7 and 8) is coupled, and a wrap spring clutch 154 for coupling the timing pulley 153 to the cam stack shaft 128. The actuating collar of the wrap spring clutch 154 is secured to the upper portion of the cam stack shaft 128. This actuating collar comprises an upper indexing portion or index ring 155 having 20 sawtooth ridges disposed about the periphery thereof at 18° intervals, and a lower portion 156 in the form of a spiral cam having an indentation or shoulder portion 157 which defines the home position of the cam stack shaft 128.

A home pawl 158 is pivotally secured to the indexing mechanism support platform 159 by means of a pin 160, the free end of the pawl 158 abutting against the shoulder 157 of the home cam 156. A home solenoid 161 has a pin 162 extending from the armature 163 thereof to engage the home pawl 158.

Similarly, an indexing pawl 164 is pivotally secured to the support plate 159 by means of a pin 165, the free end of the indexing pawl 164 engaging the index ring 155. An indexing solenoid 166 has a pin 167 extending from the armature 168 thereof to engage the pawl 164.

The direction of rotation of the timing pulley 153 and, when the wrap spring clutch 154 is engaged, the indexing and homing rings 155 and 164 and the cam stack shaft 128, is counter-clockwise as seen from the top looking down, i.e. the view shown in FIG. 12A.

When the cam stack 112 is in its home position, the shoulder 157 of the home cam 156 abuts the free end of the home pawl 158, and the free end of the indexing pawl 164 is midway between adjacent indentations of the indexing ring 155, as shown in FIG. 12A. This arrangement insures that the indexing pawl 164 will have sufficient time to engage the first indentation of the indexing ring 155 when the home pawl 158 is pulled away from the home cam 156 at the beginning of a sort run.

The control collar of the wrap spring clutch 154 operates in such a manner that the clutch is engaged whenever both the home pawl 158 and the indexing pawl 164 are pulled away from their respective homing cam and indexing ring portions of said control collar, and the clutch is disengaged whenever either of said pawls engages a shoulder portion of the corresponding homing cam or indexing ring.

When a sort run is initiated by the actuation of switch S104 (FIG. 2) by the lead edge of the first sheet of the sort run, the logic circuitry of the sorter causes the home solenoid 161 to be actuated and to remain actuated for the entire duration of the sort run, thus pulling the home pawl 158 away from the home cam portion 156 of the control collar of the wrap spring clutch 154. This causes the clutch 154 to engage, causing the cam stack 112 and the indexing ring 155 (as well as the home cam 156) to rotate approximately 9°, or one-half of the angular distance between adjacent indentations, whereupon the shoulder portion of the indentation 169 of the indexing ring 155 abuts against the free end of the pawl 164, causing the wrap spring clutch 154 to disengage.

As the trailing edge of the first copy sheet traverses the eye 97 (see FIG. 2), the logic circuitry of the sorter provides a pulse to momentarily actuate the indexing solenoid 166, thus momentarily pulling the free end of the indexing pawl 164 away from the indexing ring 155, causing the wrap spring clutch 154 to engage, whereupon the cam stack and control collar are caused to rotate clockwise through an angle of 18°, during which time the indexing pawl 164, having been urged back against the indexing ring 155 by the spring 170 upon termination of the pulse to the indexing solenoid 166, causes the wrap spring clutch 154 to again disengage.

Similarly, as each successive copy sheet of a sort sequence enters the corresponding one of the bins 32, a pulse is provided to the indexing solenoid 166 to cause the wrap spring clucth 154 to engage, so as to rotate the cam stack shaft 128 and the cam stack 112 through an angle of 18°, i.e. 1/20 of a revolution, each such rotational movement causing a corresponding protuberance 151 (FIG. 9) of one of the cams 127 to unlatch the adjacent latching assembly 141 of the corresponding gate, thus causing said gate to rotate from the open to the closed position thereof.

When the end of a sort run (i.e., no more copies in process) is detected via the switches S104 and S106 (see FIG. 2) as previously described, the sorter logic circuitry deactuates the home solenoid 161 and simultaneously actuates the indexing solenoid 166. The spring 171 then urges the home pawl 158 against the surface of the home cam portion 156 of the control collar of the wrap spring clutch 154. However, since the free end of the home pawl is not in abutment with the shoulder portion 157 of the home cam 156, the wrap spring clutch 154, which engaged upon actuation of the indexing solenoid 166, remains engaged until the cam stack 112 and the control collar of the clutch 154 have rotated to a position wherein the shoulder 157 of the home cam 156 abuts against the free end of the home pawl 158, at which time the cam stack 112 has reached its home position and the wrap spring clutch 154 is disengaged. The sorter will continue to seek home as long as no copies are sensed by switches S104 and S106.

At the same time, upon detecting the end of a sort run (i.e., no more copies in process), the sorter logic circuitry actuates the reset solenoid 135 (FIGS. 8 and 10), as previously described, to cause a single rotation of the reset cam 132, so as to vertically actuate the push rod reset assembly 139 to cause those of the latching assemblies 141 which have been unlatched during the sort sequence to be once again latched, thereby to reset the corresponding gates to their open position.

Figure 13:
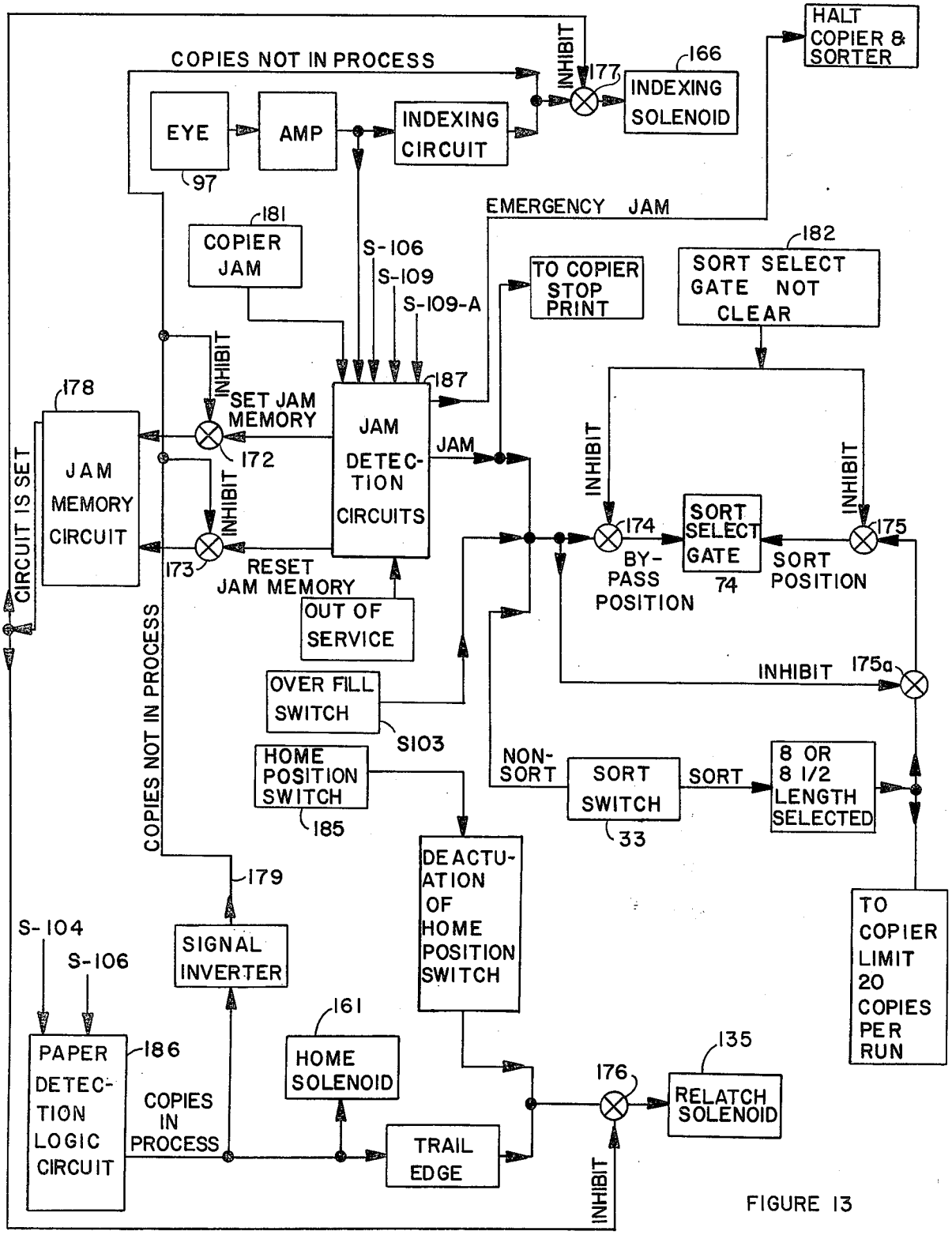
FIG. 13 is a functional block diagram of the logic control system of the sorter shown in FIG. 1.
Figure 14A:
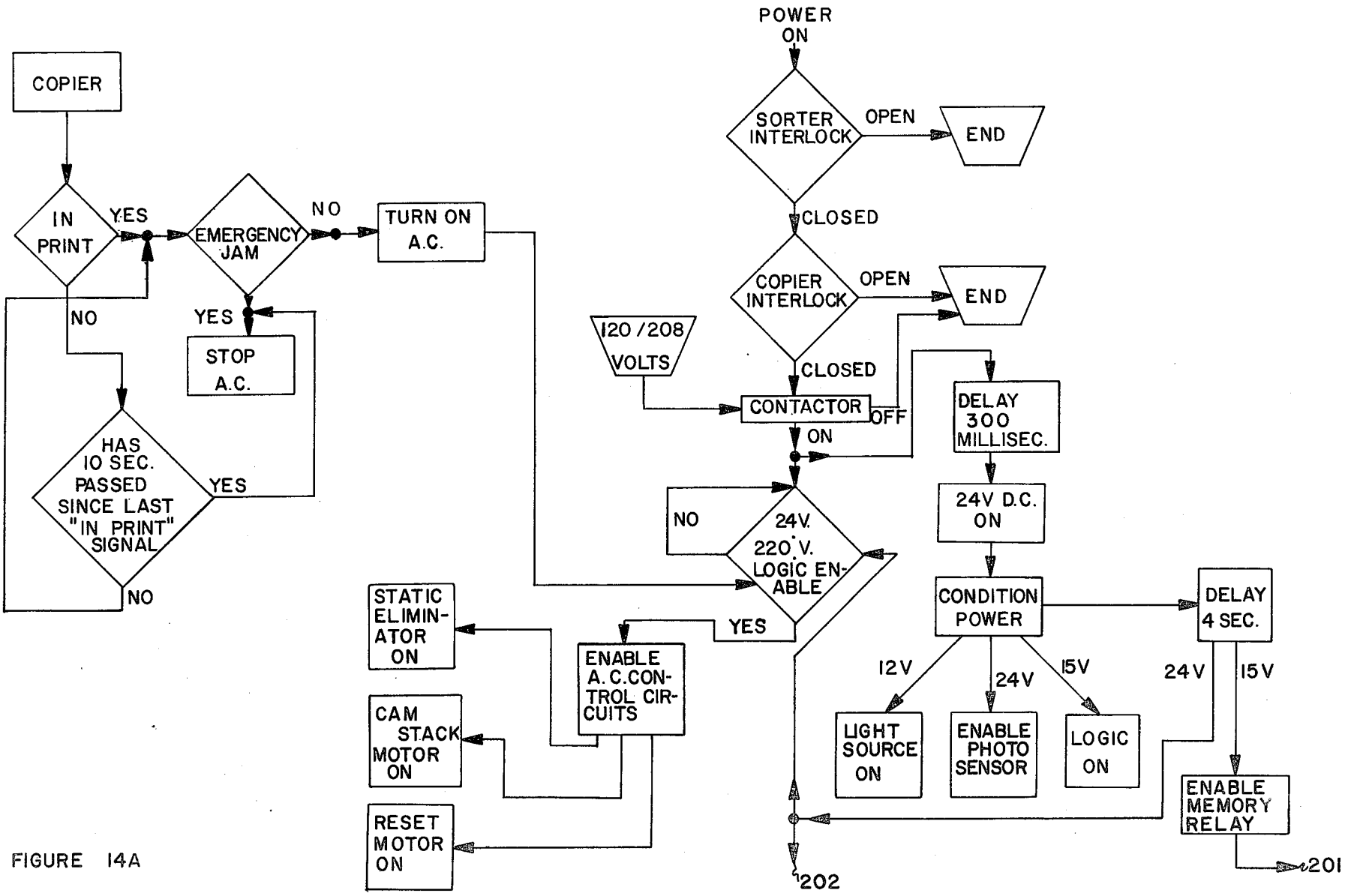
FIGS. 14A, 14B, 14C, 14D, 14E, 14F and 14G show a detailed logic diagram of the logic control system of the sorter shown in FIG. 1.
Figure 14B:
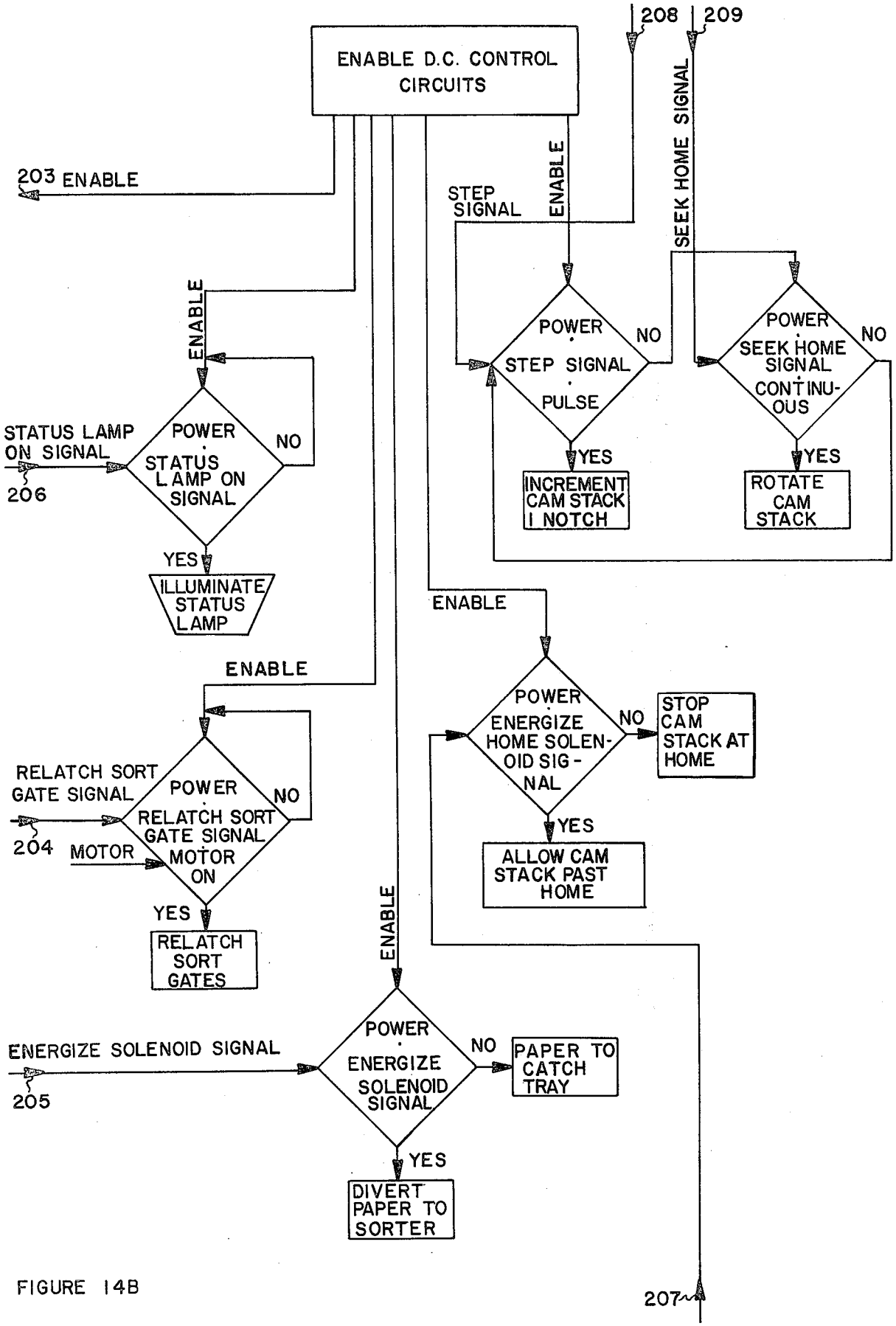
Figure 14C:
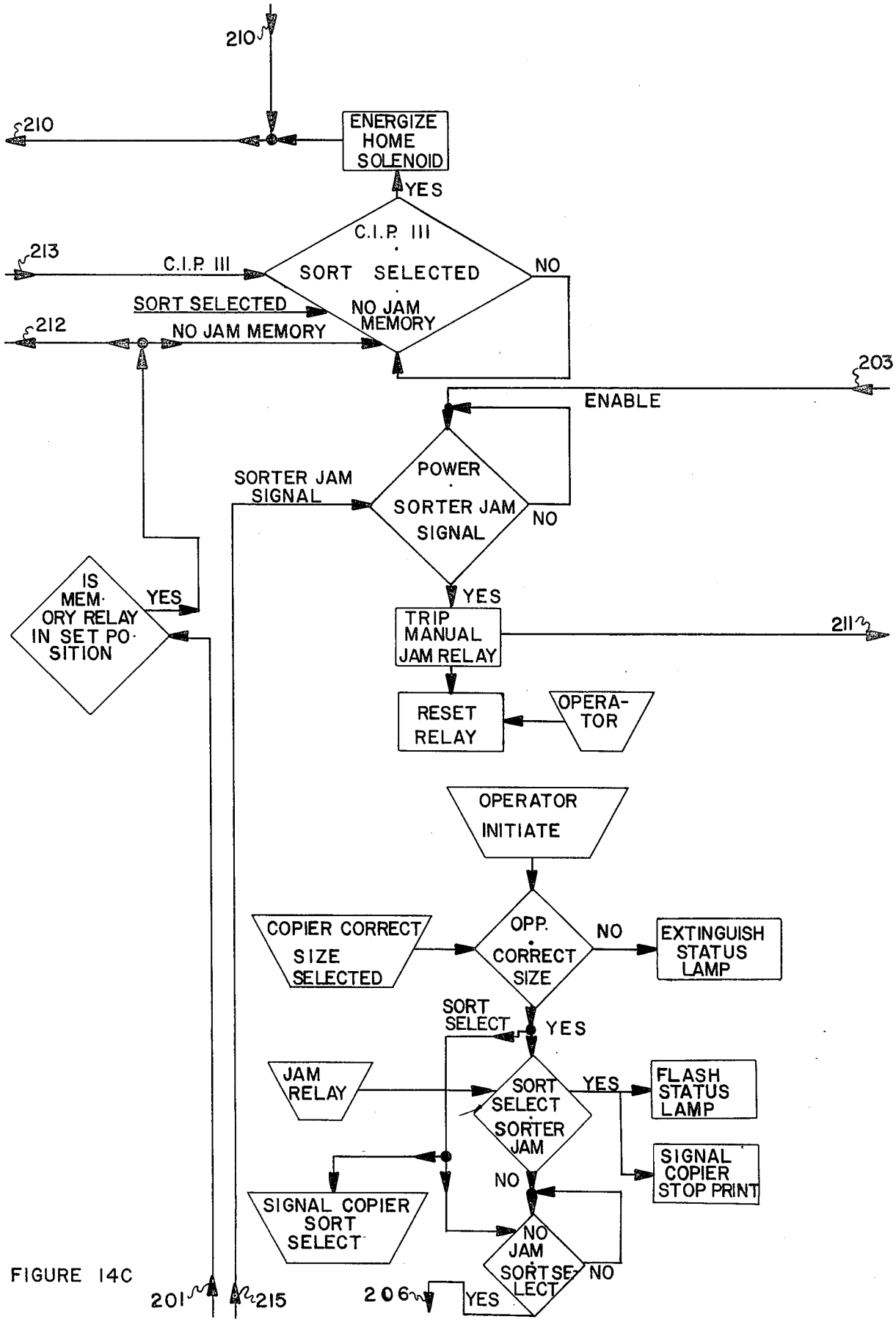
Figure 14D:
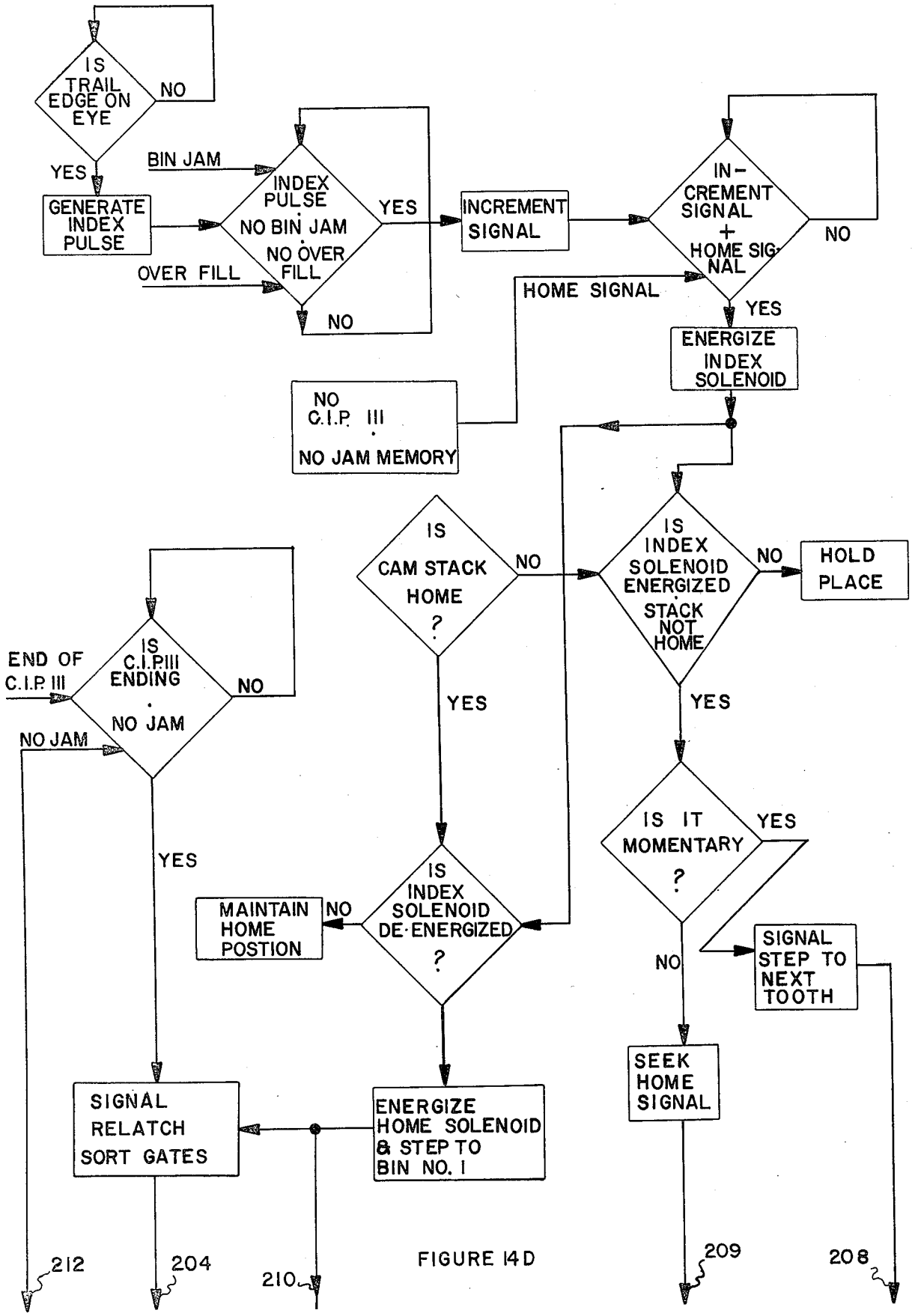
Figure 14E:
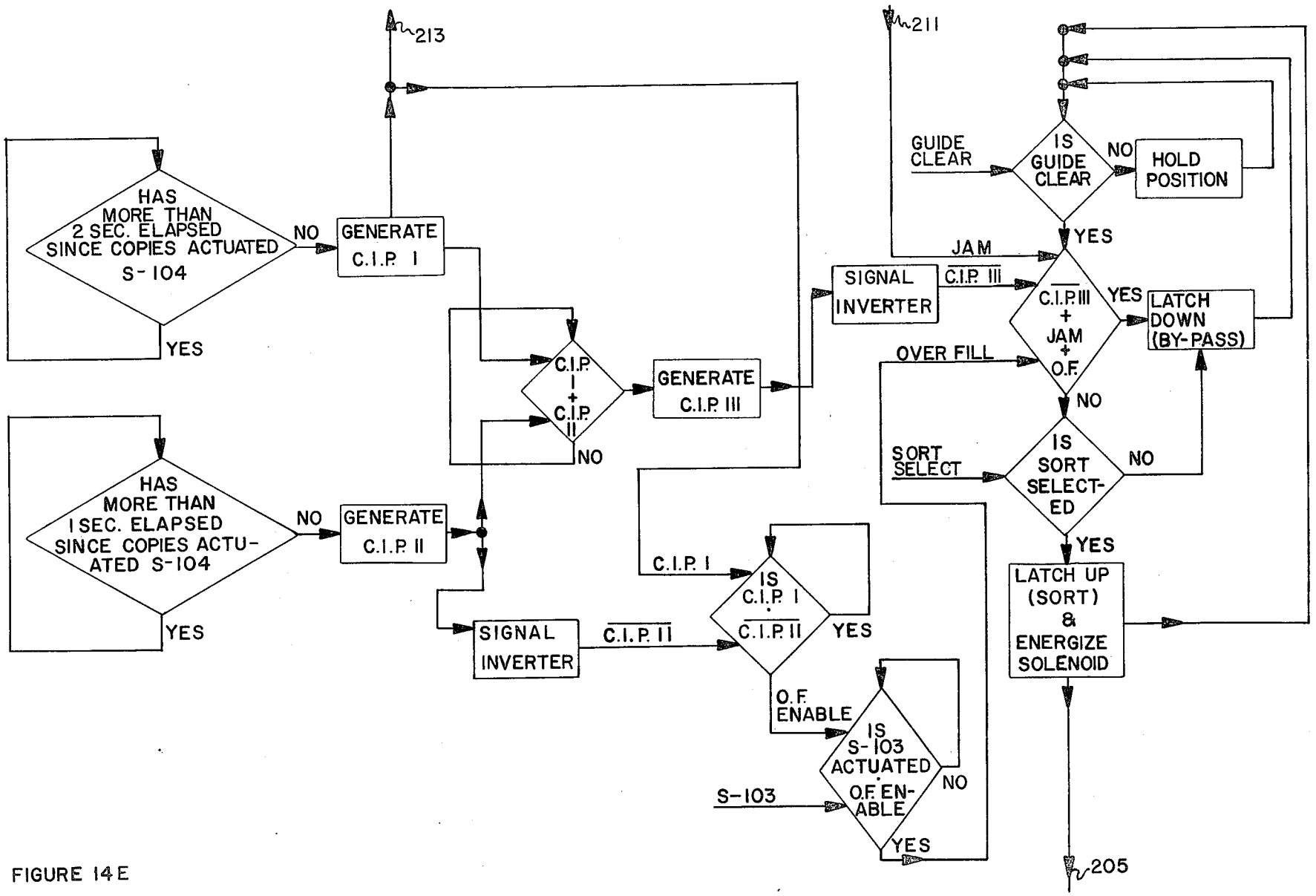
Figure 14F:
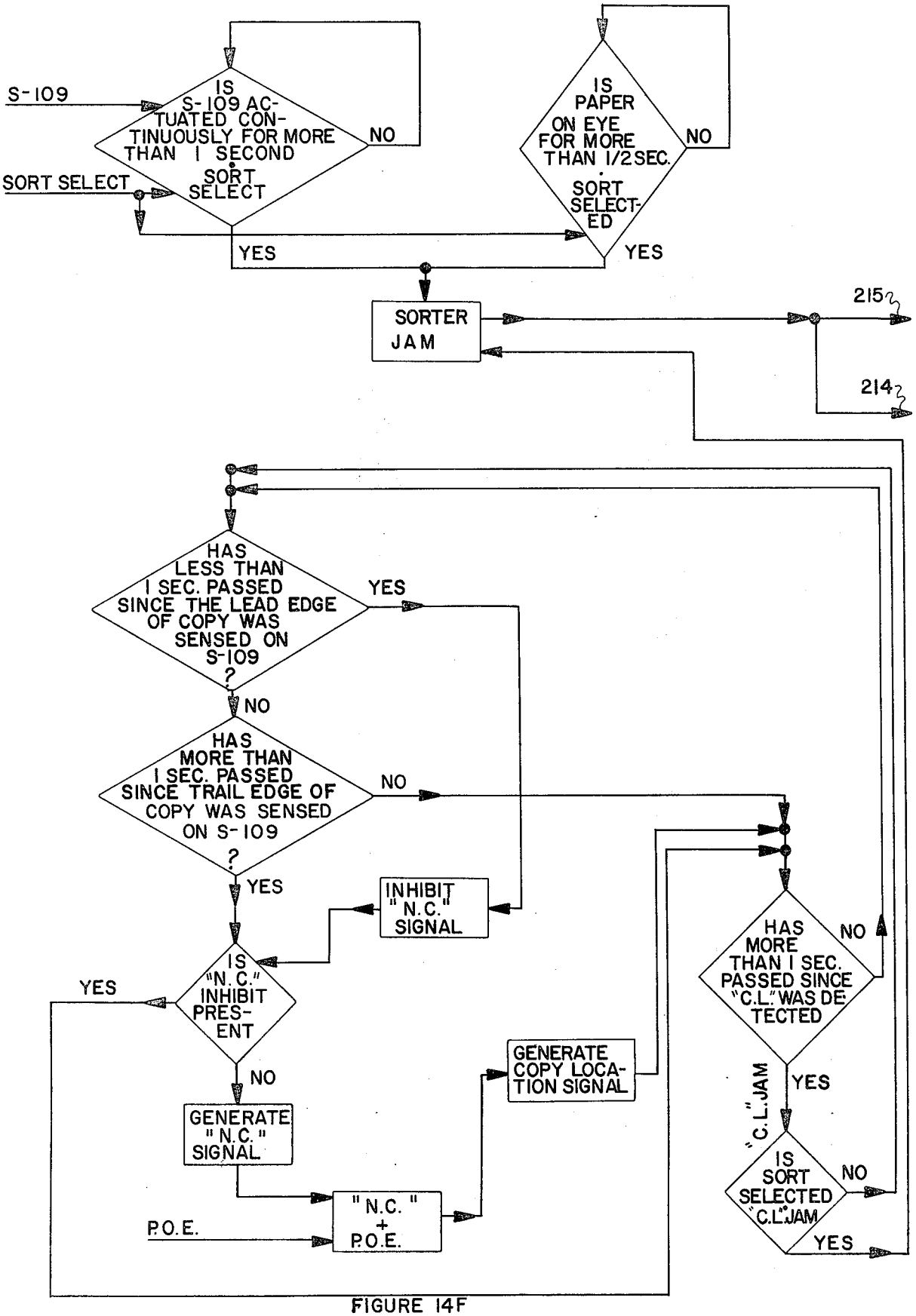
Figure 14G:
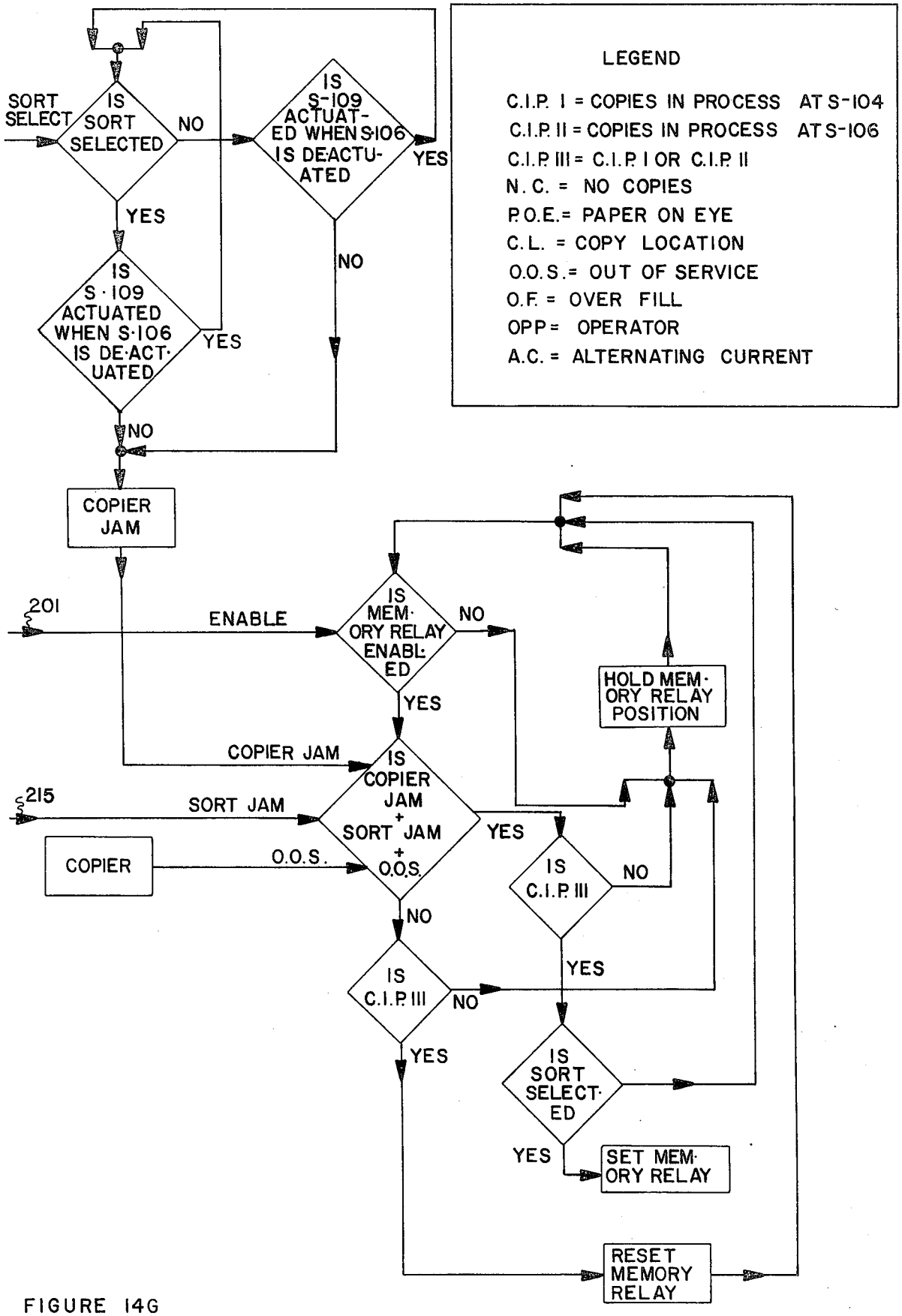

A block diagram, in functional form, representing the various logic operations performed by the sorter logic circuitry, is shown in FIG. 13. All of the logic operations have previously been described, and a highly detailed description of FIG. 13 is therefore unnecessary.

The circular units 172 through 177 represent inhibit gates.

The "OUT OF SERVICE" signal 180 is generated by the copier/duplicator 11 (FIGS. 1 and 2) whenever, for any reason, the copier/duplicator 11 is not operational, i.e. out of toner, out of paper, etc. The "copier jam" signal 81 is generated whenever a paper jam is detected within the copier.

The "sort select gate not clear" signal 182 is derived when a copy engages the actuating lever of switch S106. Unless this signal is absent, the sort select gate 74 is prevented from shifting its position.

The home position switch 185 detects the leading edge of the first copy of a new copy run and causes the gate relatch operation previously discussed to occur. When the copies in process signal is generated by the paper detection circuits 186 via information from switches S104 and S106, another gate relatch operation is initiated.

To minimize the possibility of starting a sort run with the cam stack 112 in the wrong position, the cam stack is caused to seek out its "home" or start position at all times that copies are not actually being sorted (i.e., during "copies not in process"). An exception to this is made if an "out of service" or jam condition interrupts the sorting process and thereby causes a "copies not in process" condition. Under these conditions the cam stack is prevented from seeking home. This keeps the cam stack in the proper position to complete the sort run after the "out of service" or jam condition is corrected and sorting can resume. This home inhibit feature is accomplished by the jam memory circuit 178.

Should a fault be detected while there are "copies in process", the jam detection circuits 187 "set" the jam memory circuit 178 which inhibits cam stack movement and also inhibits gate relatching when it is in its "set" condition. Use of a magnetic latching relay allows the jam memory circuit to retain its "set" condition even though all power is shut down during jam removal. After jam removal, power is reapplied. At this time the jam detection circuits 187 attempt to erase (reset) the jam memory 178, since the jam condition no longer exists. However, the "copies not in process" signal inhibits this "reset" command until the resumption of sorting ends the "copies not in process" condition. Therefore, cam stack homing and gate relatch are prevented until additional sort operations are commenced to complete the interrupted sort run.

FIG. 14 shows a much more detailed functional logic diagram of the sorter control logic circuitry, indicating the various decisions which are made by the logic circuitry during operation of the sorter.

We claim:

1. In a paper sorter for sorting paper sheets having a tendency to curl in a given direction, said sorter comprising:

a plurality of stationary, vertically stacked paper receiving bins;

transport means for moving said paper sheets along a path having a vertical portion adjacent said bins;

gate means disposed between said transport means and said bins for deflecting successive ones of said paper sheets into corresponding adjacent bins;

the improvement wherein said paper sheets are oriented so that the curl thereof results in a generally concave configuration of said sheets in said bins, said bins having a generally concave shape, with each bin having a horizontal center portion, an upwardly sloping side portion adjacent said gate means, and a deflectable upwardly sloping side portion remote from said gate means, whereby the effective storage capacity of said bins for a given overall height of said stack of bins is increased.

2. The improvement according to claim 1, wherein said deflectable side portion has a length substantially less than the length of the corresponding bin.

3. The improvement according to claim 1, wherein said deflectable side portion comprises a relatively rigid wall part, and a resilient element for biasing said wall part in an upwardly sloping direction.

4. The improvement according to claim 1, wherein each of said bins comprises a relatively rigid support plate having an upwardly sloping side portion adjacent said gate means, and a V-shaped member having two relatively rigid walls joined at the base of the V for pivoting movement with respect to one another, a resilient material being disposed between said walls, one of said walls being bonded to a portion of said support plate remote from said gate means, so that the other of said walls forms said deflectable upwardly sloping side portion of said bin.

5. A paper sorter for sorting paper sheets having a tendency to curl in a given direction, comprising:

a plurality of stationary, vertically stacked paper receiving bins;

transport means for moving said paper sheets along a path having a vertical portion adjacent said bins; and gate means disposed between said transport means and said bins for deflecting successive ones of said paper sheets into corresponding adjacent bins, each of said bins having an arcuate configuration conforming to the direction of curl of said sheets including a paper sheet supporting portion deflectable in response to the entry of said sheets into said bin, so that the effective storage capacity of said bins for a given overall height of said stack of bins is increased.

6. The improvement according to claim 1, further comprising an entrance guide lip at the edge of said upwardly sloping side portion adjacent said gate means, for guiding sheets entering each of said bins toward the top thereof.

7. The improvement according to claim 1, further comprising at least two transverse ridges extending from the bottom surface of each bin.

8. An array of stationary, vertically stacked paper receiving bins for a paper sorter, each bin having a generally concave shape with two upwardly sloping side portions separated by a center portion, one of said side portions being deflectable, a resilient element for biasing said deflectable side portion in said upwardly sloping direction, an entrance guide lip at the edge of the other of said side portions for guiding sheets entering said bin toward the top thereof, and at least two transverse ridges extending from the bottom surface of said bin.

9. A paper sorter for sorting paper sheets delivered by another apparatus, said sorter comprising:

a plurality of stationary, vertically stacked paper receiving bins;

transport means for moving said paper sheets along a path having a vertical portion adjacent said bins, the speed of movement of said transport means being substantially greater than the speed of delivery of said sheets by said other apparatus;

said transport means having a first portion adjacent said other apparatus for receiving the sheets delivered by said apparatus, said first portion including means for grasping said sheets with a force substantially less than the force with which said sheets are held by said apparatus, so that said sheets slip with respect to said first portion of said transport means until they are released by said apparatus, said first portion of said transport means grasping said sheets and accelerating them to the speed of movement thereof as soon as said sheets are released by said apparatus, whereby the speed of operation of said transport means is subatantially independent of the speed of delivery of said sheets by said other apparatus; and gate means disposed between the vertical portion of said transport means and said bins for deflecting successive ones of said paper sheets into corresponding adjacent bins.

10. The sorter according to claim 9, wherein said transport means includes a transport support belt, and said first portion of said transport means includes at least one idler belt disposed in contiguous relationship with and driven by said support belt.

11. The sorter according to claim 10, wherein said support belt is electrically conductive, further comprising means for manually moving said support belt to enable paper sheets to be removed therefrom in the event of malfunction of said apparatus or said sorter.

12. A paper sorter for sorting paper sheets, comprising:

a plurality of stationary, vertically stacked paper receiving bins;

transport means for moving said paper sheets along a path having a vertical portion adjacent said bins, said vertical portion including at least two vertically movable strips, a vertically aligned array of horizontal idler rollers disposed in contiguous relationship with said vertically movable strips, said rollers being disposed between said strips and said bins, a vertical paper supporting structure disposed adjacent said rollers, said strips protruding beyond said structure to engage said rollers, a stationary elongated resilient element for urging each said strip against said rollers; and gate means disposed between said paper supporting structure and said bins for deflecting successive ones of said paper sheets into corresponding adjacent bins.

13. The sorter according to claim 12, wherein said paper supporting structure has a generally corrugated configuration, with horizontal corrugations.

14. The sorter according to claim 13, wherein said gate means comprises a plurality of pivotally mounted horizontally disposed gates, one of said gates being disposed adjacent each of said bins, each gate being pivotable between an open position in which any sheet encountering said gate while moving along said vertical portion of said path is deflected by said gate into the adjacent bin, and a closed position in which said gate does not affect sheets moving along said vertical portion of said path.

15. The sorter according to claim 14, wherein in the open position an edge of each of said gates extends into a corresponding horizontal groove of said corrugated paper supporting structure.

16. The sorter according to claim 15, wherein each gate is coaxial with a corresponding one of said idler rollers.

17. The sorter according to claim 16, wherein said edge of each of said gates has recesses therein for receiving said movable strips when said gate is in the open position.

18. A paper sorter for sorting paper sheets, comprising:

a plurality of stationary, vertically stacked paper receiving bins;

transport means for moving said paper sheets along a path having a vertical portion adjacent said bins, said vertical portion including at least two vertically movable strips, a vertically aligned array of horizontal idler rollers disposed in contiguous relationship with said vertically movable strips, said rollers being disposed between said strips and said bins, a generally corrugated vertical paper supporting structure having horizontal corrugations, means for urging said movable strips against said rollers; and gate means comprising a plurality of pivotally mounted horizontally disposed gates, one of said gates being disposed adjacent each of said bins, each gate being pivotable between an open position in which any sheet encountering said gate while moving along said vertical portion of said path is deflected by said gate into the adjacent bin, and a closed position in which said gate does not affect sheets moving along said vertical portion of said path, each gate in the open position having an edge extending into a corresponding groove of said corrugated paper supporting structure, each of said edges having recesses therein for receiving said movable strips when the corresponding gate is in the open position.

19. The sorter according to claim 18, further comprising hinge support means for pivoting said bins, gates and rollers away from said paper supporting structure.

20. The sorter according to claim 18, further comprising means for latching each of said gates in said open position, cam stack means for successively tripping each of said latching means to successively close said gates in response to the movement of paper sheets into the corresponding bins, and means for simultaneously resetting all of said latching means to return said gates to their open positions.

21. The sorter according to claim 20, further comprising photoelectric means for detecting the trailing edge of each of said sheets as the sheet passes into one of said bins, said cam means including a cam stack having one cam for each of said gates, each of said cams having an actuating portion for engaging the latching means associated with the corresponding gate, said actuating portions being rotationally displaced relative to each other so that they successively engage the corresponding gates as said cam stack is rotated, and indexing means coupled to said photoelectric means for rotating said cam stack through an angle sufficient to trip the latching means of each gate after said photoelectric means detects the passage of one of said sheets into the corresponding one of said bins.

22. The sorter according to claim 21, wherein said resetting means includes a push rod for simultaneously engaging each of said latching means, a cam follower connected to said push rod, and a reset cam for actuating said cam follower.

23. The sorter according to claim 21, further comprising means for sensing completion of a sorting operation, and cam stack homing means for rotating said cam stack to an initial position corresponding to the beginning of a sorting operation.

24. The sorter according to claim 23, further comprising means for inhibiting operation of said homing means in response to a malfunction in any apparatus providing said paper sheets to said sorter.

25. The sorter according to claim 23, further comprising means including said photoelectric means for detecting malfunctions of said sorter, and means coupled to said detecting means for halting the operation of said sorter when said malfunction occurs in the vertical portion of the path of said transport means.

26. The sorter according to claim 25, further including malfunction detection means for generating a malfunction signal when the time between successive operations of said indexing means exceeds a predetermined value.

27. The sorter according to claim 23, wherein said transport means has a paper delivery portion adjacent said vertical portion of said path, further comprising a paper catch tray, second transport means adjacent said paper delivery portion of said first-mentioned transport means for moving any sheets diverted from said first-mentioned transport means to said paper catch tray, and a sort select gate adjacent said second transport means and both the paper delivery portion and vertical portion of said first-mentioned transport means, for selectively diverting paper sheets from said first-mentioned transport means to said second transport means when said sort select gate is in a bypass position, and for causing paper sheets to move from said paper delivery portion to said vertical portion of said first-mentioned transport means when said sort select gate is in a sort position.

28. The sorter according to claim 27, further comprising means to move said sort select gate from the sort position to the bypass position when the capacity of the sorter is exceeded.

29. The sorter according to claim 18, wherein said transport means includes at least one electrically conductive paper moving belt for contacting said paper sheets to discharge any static electricity therefrom, said idler rollers also being electrically conductive.

30. In combination, an electrophotographic copying machine and a paper sorter for sorting paper sheets delivered by said machine, said combination comprising:

a plurality of stationary, vertically stacked paper receiving bins;

transport means including a paper support belt common to both said copying machine and said sorter for moving said paper sheets along a path having a paper delivery portion for receiving said sheets within said copying machine, said paper delivery portion being adapted to move said sheets to a transport junction within said sorter, said transport means having a vertical portion adjacent said junction;

said vertical portion of said transport means including at least two vertically movable strips, a vertically aligned array of horizontal idler rollers disposed in contiguous relationship with said vertically movable strips, said rollers being disposed between said strips and said bins, a vertical paper supporting structure disposed adjacent said rollers, said strips being disposed between said rollers and said supporting structure, and resilient means operatively associated with said supporting structure for urging said strips against said rollers for grasping and moving any paper sheets disposed therebetween;

a paper catch tray attached to said sorter;

a bypass transport for moving paper sheets from said junction to said paper catch tray;

a sort select gate at said junction having a sort position for effecting transfer of paper sheets from said paper delivery portion to said vertical portion of said transport means, and a bypass position for effecting transfer of paper sheets from said paper delivery portion of said transport means to said paper catch tray via said bypass transport;

means for disposing said sort select gate in said bypass position when a malfunction is detected in the portion of said sorter associated with the vertical portion of said transport means;

means for disposing said sort select gate in said sort position when sorting of paper sheets delivered by said copying machine is desired, as indicated by a signal placing said sorter in a sort mode of operation, and for disposing said sort select gate in said bypass position when the capacity of said sorter is exceeded, thus causing any excess paper sheets to be deposited in said paper catch tray; and gate means between the vertical portion of said transport means and said bins for deflecting successive ones of said paper sheets into corresponding adjacent bins.

31. The combination according to claim 30, further comprising means for disposing said sort select gate in said bypass position when the length of the paper sheets delivered by said copying machine is outside a predetermined range.

32. The combination according to claim 30, further comprising means for resetting said gate means upon completion of each sorting operation, and means for inhibiting the operation of said resetting means when a sorting operation is interrupted as a result of a malfunction in said copying machine.

33. The combination according to claim 30, wherein said gate means comprises a plurality of pivotally mounted horizontally disposed gates, one of said gates being disposed adjacent each of said bins, each gate being pivotable between an open position in which any sheet encountering said gate while moving along said vertical portion of said path is deflected by said gate into the adjacent bin, and a closed position in which said gate does not affect sheets moving along said vertical portion.

34. The combination according to claim 33, wherein said supporting structure has a generally corrugated configuration with horizontal corrugations, and wherein in the open position an edge of each of said gates extends into a corresponding horizontal groove of said corrugated paper supporting structure.

35. The combination according to claim 34, wherein each gate is coaxial with a corresponding one of said idler rollers.

36. The combination according to claim 35, wherein said edge of each of said gates has recesses therein for receiving said movable strips when said gate is in the open position.

37. In combination, an electrophotographic copying machine and a paper sorter for sorting paper sheets delivered by said machine, said combination comprising:

a plurality of stationary, vertically stacked paper receiving bins;

transport means including a paper support belt common to both said copying machine and said sorter for moving said paper sheets along a path having a paper delivery portion for receiving said sheets within said copying machine, said paper delivery portion being adapted to move said sheets to a transport junction within said sorter, said transport means having a vertical portion adjacent said junction;

the speed of paper movement along the paper delivery portion of said transport means being substantially greater than the speed of delivery of said sheets from said copying machine to said paper delivery portion, said paper delivery portion of said transport means including means for grasping said sheets with a force substantially less than the force with which said sheets are held by said copying machine, so that said sheets slip with respect to said paper delivery portion of said transport means until they are released by said copying machine, said paper delivery portion of said transport means grasping said sheets and accelerating them to the speed of movement thereof as soon as said sheets are released by said copying machine, whereby the speed of operation of said transport means is substantially independent of the speed of delivery of said sheets by said copying machine;

a paper catch tray attached to said sorter;

a bypass transport for moving paper sheets from said junction to said paper catch tray;

a sort select gate at said junction having a sort position for effecting transfer of paper sheets from said paper delivery portion to said vertical portion of said transport means, and a bypass position for effecting transfer of paper sheets from said paper delivery portion of said transport means to said paper catch tray via said bypass transport;

means for disposing said sort select gate in said bypass position when a malfunction is detected in the portion of said sorter associated with the vertical portion of said transport means;

means for disposing said sort select gate in said sort position when sorting of paper sheets delivered by said copying machine is desired, as indicated by a signal placing said sorter in a sort mode of operation, and for disposing said sort select gate in said bypass position when the capacity of said sorter is exceeded, thus causing any excess paper sheets to be deposited in said paper catch tray; and gate means disposed between the vertical portion of said transport means and said bins for deflecting successive ones of said paper sheets into corresponding adjacent bins.

38. The combination according to claim 37, wherein said paper delivery portion of said transport means includes a transport support belt, and at least one idler belt disposed in contiguous relationship with and driven by said support belt.

39. In combination, an electrophotographic copying machine and a paper sorter for sorting paper sheets delivered by said machine, said combination comprising:

a plurality of stationary, vertically stacked paper receiving bins;

transport means including a paper support belt common to both said copying machine and said sorter for moving said paper sheets along a path having a paper delivery portion for receiving said sheets within said copying machine, said paper delivery portion being adapted to move said sheets to a transport junction within said sorter, said transport means having a vertical portion adjacent said junction;

a paper catch tray attached to said sorter;

a bypass transport for moving paper sheets from said junction to said paper catch tray;

a sort select gate at said junction having a sort position for effecting transfer of paper sheets from said paper delivery portion to said vertical portion of said transport means, and a bypass position for effecting transfer of paper sheets from said paper delivery portion of said transport means to said paper catch tray via said bypass transport;

means for disposing said sort select gate in said bypass position when a malfunction is detected in the portion of said sorter associated with the vertical portion of said transport means;

means for disposing said sort select gate in said sort position when sorting of paper sheets delivered by said copying machine is desired, as indicated by a signal placing said sorter in a sort mode of operation, and for disposing said sort select gate in said bypass position when the capacity of said sorter is exceeded, thus causing any excess paper sheets to be deposited in said paper catch tray; and gate means disposed between the vertical portion of said transport means and said bins for deflecting successive ones of said paper sheets into corresponding adjacent bins, wherein said paper sheets have a tendency to curl in a given direction, said sheets being oriented so that the curl thereof results in a generally concave configuration of said sheets in said bins, said bins having a generally concave shape, with each bin having a horizontal center portion, an upwardly sloping side portion adjacent said gate means, and another upwardly sloping side portion remote from said gate means, whereby the effective storage capacity of said bins for a given overall height of said stack of bins is increased.

40. The combination according to claim 39, wherein said other upwardly sloping side portion of each of said bins is deflectable.

41. The combination according to claim 40, wherein said deflectable side portion comprises a relatively rigid wall part, and a resilient element for biasing said wall part in an upwardly sloping direction.

42. The combination according to claim 41, further comprising at least two transverse ridges extending from the bottom surface of each of said bins.

43. The combination according to claim 42, further comprising an entrance guide lip at the edge of said upwardly sloping side portion adjacent said gate means, for guiding sheets entering each of said bins toward the top thereof.

44. The combination according to claim 39, wherein each of said bins comprises a relatively rigid support plate having an upwardly sloping side portion adjacent said gate means, and a V-shaped member having two relatively rigid walls joined at the base of the V for pivoting movement with respect to one another, a resilient material being disposed between said walls, one of said walls being bonded to a portion of said support plate remote from said gate means, so that the other of said walls forms said deflectable upwardly sloping side portion of said bin.

45. The combination according to claim 30, further comprising means for limiting the number of copies of each original document made by said copying machine to a value equal to the capacity of said sorter when said sorter is in the sort mode.

46. In combination, an electrophotographic copying machine and a paper sorter for sorting paper sheets delivered by said machine, said sheets having a tendency to curl in a given direction, said combination comprising:

a plurality of stationary, vertically stacked paper receiving bins, each of said bins having a generally concave configuration;

transport means for delivering paper sheets from said copying machine to a junction point, and for transporting said sheets from said junction point along a vertical path adjacent said bins;

a paper catch tray;

a bypass transport for moving paper sheets from said junction point to said paper catch tray;

a sort select gate at said junction, said gate having a sort position wherein said sheets are transferred from said junction point to said vertical path, and a bypass position wherein said sheets are transferred from said junction point to said bypass transport;

a switch for placing said sorter in a sort mode, and means coupled to said switch for disposing said sort select gate in said sort position thereof;

a plurality of horizontally disposed gates, one of said gates being positioned adjacent each of said bins, each gate being movable between an open position in which any sheet encountering said gate while moving along said vertical path is deflected by said gate into the adjacent bin, and a closed position in which said gate does not affect sheets moving along said vertical path;

means for actuating each gate from the open to the closed position thereof after a sheet has entered the corresponding bin; and means for resetting all said gates to the open positions thereof after the last of said sheets has passed into the corresponding one of said bins.

47. The combination according to claim 46, further comprising means for limiting the number of copies of each original document made by said copying machine to a value equal to the capacity of said sorter when said sorter is in the sort mode.

48. The combination according to claim 46, further comprising means for disposing said sort select gate in said bypass position (i) when a malfunction is detected in the path of said sorter operatively associated with said vertical path, (ii) when the length of the paper sheets delivered by said copying machine is outside a predetermined range, and (iii) when the capacity of said sorter is exceeded.

49. The combination according to claim 48, further comprising means for inhibiting the operation of said resetting means when a sorting operation is interrupted as a result of a malfunction in said copying machine.

50. The combination according to claim 46, further comprising static elimination means disposed adjacent said sort select gate for discharging any static charge on said paper sheets as they traverse said sort select gate, said sort select gate being positioned so that an air gap exists between said sort select gate and said sheets in the vicinity of said static elimination means.

* * * * *